US010336080B2

(12) United States Patent
Kudo et al.

(10) Patent No.: US 10,336,080 B2
(45) Date of Patent: Jul. 2, 2019

(54) LIQUID SUPPLY APPARATUS AND PRINTING APPARATUS

(71) Applicant: SEIKO EPSON CORPORATION, Tokyo (JP)

(72) Inventors: Shoma Kudo, Nagano (JP); Naomi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/730,911

(22) Filed: Oct. 12, 2017

(65) Prior Publication Data

US 2018/0111378 A1 Apr. 26, 2018

(30) Foreign Application Priority Data

Oct. 26, 2016 (JP) ..... 2016-209512

(51) Int. Cl.
*B41J 2/17* (2006.01)
*B41J 2/175* (2006.01)
(Continued)

(52) U.S. Cl.
CPC ..... *B41J 2/1721* (2013.01); *B41J 2/175* (2013.01); *B41J 2/1752* (2013.01); *B41J 2/17509* (2013.01); *B41J 2/17513* (2013.01); *B41J 2/17553* (2013.01); *B41J 2/17566* (2013.01); *B41J 29/02* (2013.01); *B41J 29/13* (2013.01); *B41J 2/17523* (2013.01); *B41J 2002/1742* (2013.01)

(58) Field of Classification Search
CPC .. B41J 2/1721; B41J 2/17566; B41J 2/17513; B41J 2002/1742; B41J 2/17523; B41J 2/17553; B41J 2/175; B41J 2/1752; B41J 2/17509; B41J 29/02; B41J 29/13; B41J 2/17506; B41J 2/185
USPC ..... 347/7, 84–86
See application file for complete search history.

(56) References Cited

U.S. PATENT DOCUMENTS 5,801,736 A * 9/1998 Ikkatai ..... B41J 2/16523 347/86
8,529,039 B2 * 9/2013 Shibata ..... B41J 2/14233 347/89
(Continued)

FOREIGN PATENT DOCUMENTS

CN 104015492 A 9/2014
JP 2015-080907 A 4/2015
WO WO-2014132634 A1 * 9/2014 ..... B41J 2/17553

*Primary Examiner* — Jannelle M Lebron

(57) ABSTRACT

At least some issues such as making it difficult for liquid to leak to the outside, making it easy for liquid contained in a buffer chamber to return to a liquid storage portion, and suppressing an increase in the installation area of the entirety of a printing apparatus is achieved. A liquid supply apparatus includes a liquid tank that contain a liquid, a connection channel member connected to the liquid tank, and a buffer tank that is configured separately from the liquid tank, is connected to the liquid tank via the connection channel member, and is communicated with the atmospheric air. The liquid tank includes a liquid storage chamber provided inside of the liquid tank, and a liquid inlet portion for injecting liquid into the liquid storage chamber. The buffer tank has a buffer chamber, bottom face of the buffer chamber is positioned at a position higher than a maximum liquid level of the liquid tank.

11 Claims, 22 Drawing Sheets

(51) Int. Cl.
*B41J 29/13* (2006.01)
*B41J 29/02* (2006.01)

(56) References Cited

U.S. PATENT DOCUMENTS

| | | | | |
|---|---|---|---|---|
| 9,561,665 | B2 * | 2/2017 | Okayama | B41J 2/175 |
| 9,724,930 | B2 * | 8/2017 | Enomoto | B41J 2/17596 |
| 2009/0002433 | A1 * | 1/2009 | Shimizu | B41J 2/1652<br>347/30 |
| 2009/0102879 | A1 * | 4/2009 | Katada | B41J 2/175<br>347/17 |
| 2010/0079562 | A1 * | 4/2010 | Katada | B41J 2/175<br>347/85 |
| 2011/0074887 | A1 * | 3/2011 | Manders | B41J 2/175<br>347/54 |
| 2015/0109386 | A1 | 4/2015 | Koike et al. | |
| 2016/0009096 | A1 | 1/2016 | Suzuki et al. | |
| 2016/0009100 | A1 | 1/2016 | Kudo et al. | |
| 2016/0016409 | A1 | 1/2016 | Kimura et al. | |
| 2016/0318307 | A1 | 11/2016 | Koike et al. | |
| 2017/0008298 | A1 | 1/2017 | Suzuki et al. | |

* cited by examiner

LIQUID SUPPLY APPARATUS AND PRINTING APPARATUS

CROSS-REFERENCE TO RELATED APPLICATIONS

The present application claims the priority based on Japanese Patent Applications No. 2016-209512 filed on Oct. 26, 2016, the disclosures of which are hereby incorporated by reference in their entirety.

BACKGROUND

1. Technical Field

The present invention relates to a liquid supply apparatus for supplying liquid such as ink, and a printing apparatus provided with the liquid supply apparatus.

2. Related Art

JP-A-2015-80907 discloses a liquid container having a liquid storage chamber and a buffer chamber, as a liquid container (a liquid supply apparatus) for supplying ink to a printer. The buffer chamber is for suppressing the leakage of a liquid in the liquid storage chamber to the outside due to environmental changes (change in air pressure, temperature, orientation and the like). In JP-A-2015-80907, the buffer chamber is arranged above the liquid storage chamber.

JP-A-2015-80907 is an example of related art.

In the above example of related art, a configuration is described in which the buffer chamber is provided in the liquid container. However, there is room for further improvement regarding the configuration and arrangement of the liquid supply apparatus having the liquid storage chamber and the buffer chamber, and there are the following demands.

First, as a structure of the liquid supply apparatus, there are demands for a structure in which liquid is unlikely to leak to the outside. Specifically, for example, there are demands for a structure in which liquid is unlikely to leak even due to a change in the environment (change in air pressure, temperature, orientation and the like) in which the liquid supply apparatus is placed. In addition, there are demands for a structure in which liquid contained in the buffer chamber can easily return to the liquid storage portion, and the amount of unused liquid that remains can be reduced.

Secondly, there are demands for a liquid supply apparatus that can suppress an increase in the installation area of the whole printing apparatus. Specifically, for example, there are demands for space-efficient arrangement of a plurality of liquid storage chambers and channel members connected to the liquid storage chambers.

Note that above-described issues are not limited to a liquid supply apparatus for a printer, but are also common to a liquid supply apparatus for supplying another type of liquid, and a liquid ejection apparatus that uses such a liquid supply apparatus.

SUMMARY

The invention has been made in order to solve at least some of the above-described issues, and can be realized as the following modes or application examples.

(1) According to one mode of the invention, a liquid supply apparatus for supplying a liquid to a liquid ejection unit is provided. This liquid supply apparatus includes a liquid tank that contain liquid; a connection channel member connected to the liquid tank; and a buffer tank that is configured separately from the liquid tank, is connected to the liquid tank via the connection channel member, and is communicated with atmospheric air. The liquid tank has a liquid storage chamber provided inside of the liquid tank and a liquid inlet portion for injecting liquid into the liquid storage chamber. The buffer tank has a buffer chamber whose bottom face is positioned at a position higher than a maximum liquid level of the liquid tank.

According to this liquid supply apparatus, the buffer tank is connected to the liquid tank, and thus there is an effect in that liquid is unlikely to leak to the outside. In addition, the buffer tank has the buffer chamber whose bottom face is positioned at a position higher than the maximum liquid level of the liquid tank, and thus it is possible to make it difficult for liquid to leak out from the liquid storage chamber to the buffer chamber. It is also possible to make it easy for liquid, which has flowed out from the liquid storage chamber to the buffer chamber, to return to the liquid storage chamber, and as a result, the amount of unused liquid can be reduced. Furthermore, the liquid tank and the buffer tank are configured separately, and thus there is an effect in that it is easy to increase/decrease the volume of the liquid storage chamber and the volume of the buffer chamber independently.

(2) In the above liquid supply apparatus, it may be preferable that the connection channel member is held higher than the maximum liquid level.

According to this configuration, liquid is unlikely to flow out from the liquid storage chamber to the buffer chamber, and liquid is likely to return from the buffer chamber to the liquid storage chamber. Furthermore, there is an effect in that it is easy to attach the connection channel member when manufacturing the liquid supply apparatus.

(3) In the above liquid supply apparatus, it may be preferable that the liquid tank includes a plurality of the liquid storage chambers that are arranged in a first direction, the plurality of the liquid storage chambers contain a plurality of different types of liquid, and the buffer tank includes a plurality of the buffer chambers arranged in a direction parallel to the first direction.

According to this configuration, it is possible to suppress an excessive increase in the size of the liquid supply apparatus in a direction intersecting the first direction (4) In the above liquid supply apparatus, it may be preferable that the liquid tank includes a plurality of the liquid storage chambers that are arranged in the first direction, the plurality of the liquid storage chambers contain a plurality of different types of liquid, and the buffer tank includes a plurality of the buffer chambers arranged in a second direction intersecting the first direction.

According to this configuration, it is possible to suppress an excessive increase in the size of the liquid supply apparatus in the first direction.

(5) According to another mode of the invention, a liquid supply apparatus for supplying liquid to a liquid ejection unit is provided. This liquid supply apparatus includes a liquid tank that contain a liquid; a connection channel member connected to the liquid tank; a buffer tank that is configured separately from the liquid tank, is connected to the liquid tank via the connection channel member, and is communicated with atmospheric air. The liquid tank includes a liquid storage chamber provided inside the liquid tank and a liquid inlet portion for injecting liquid into the liquid storage chamber, the liquid tank provides a first liquid level, at a height lower than or equal to an end portion of the liquid inlet portion that is open to the inside of the liquid storage chamber, the first liquid level is set as an indicator of an upper limit of an amount of liquid that is contained in the liquid tank. The buffer tank has a buffer chamber, bottom face of the buffer chamber is positioned at a position lower than the first liquid level. The connection channel member connects the liquid tank and the buffer tank via a position higher than the first liquid level.

According to this liquid supply apparatus, the buffer tank is connected to the liquid tank, and thus liquid is unlikely to leak. In addition, the connection channel member connects the liquid tank and the buffer tank via a position higher than the first liquid level, and thus there is an effect in that liquid is unlikely to flow out from the liquid storage chamber to the buffer chamber. Furthermore, the liquid tank and the buffer tank are configured separately, and thus there is an effect in that it is easy to increase/decrease the volume of the liquid storage chamber and the volume of the buffer chamber independently.

(6) In the above liquid supply apparatus, it may be preferable that the buffer tank includes the buffer chamber, an air chamber including an atmospheric air opening port, and a partition wall that partitions the buffer chamber and the air chamber, and the buffer chamber and the air chamber are in communication with each other through an opening provided in an upper portion of the partition wall.

According to this configuration, liquid does not flow out to the air chamber unless the liquid reaches an upper portion of the buffer chamber, and thus there is an effect in that liquid is unlikely to flow out from the atmospheric air opening port to the outside.

(7) According to yet another mode of the invention, a printing apparatus having a liquid ejection unit and one of the above-described liquid supply apparatuses is provided.

Also in this printing apparatus, similarly to the above-described modes, there is an effect in that liquid is unlikely to leak to the outside of the printing apparatus.

(8) In the above printing apparatus, it may be preferable that when the printing apparatus excluding the liquid supply apparatus is projected from above, at least a portion of the liquid supply apparatus is included inside an outer periphery of the printing apparatus.

According to this configuration, it is possible to suppress an excessive increase in the installation area of the printing apparatus.

(9) According to yet another mode of the invention, a printing apparatus including a movable liquid ejection unit; the above-described liquid supply apparatus (3); a medium discharging unit for discharging, in a second direction intersecting the first direction, a printing medium printed onto by ejecting liquid from the liquid ejection unit; and an operation panel positioned above the medium discharging unit is provided. In this printing apparatus, at least a portion of the liquid tank is positioned on the same side as the medium discharging unit relative to a movement region of the liquid ejection unit that moves in the first direction, and at least a portion of the buffer tank is arranged between the operation panel and the movement region.

According to this printing apparatus, it is possible to suppress an increase in the size of the printing apparatus in the second direction that is a discharge direction of a printing medium. In addition, there is often an empty space in the periphery of the movement region of the liquid ejection unit of the printing apparatus, and thus the liquid tank and the buffer tank can be positioned using this empty space. Furthermore, in this printing apparatus, at least a portion of the liquid tank is positioned on the same side as the medium discharging unit relative to the movement region of the liquid ejection unit, and thus there is an effect in that liquid is easily supplied to the liquid ejection unit.

(10) According to yet another mode of the invention, a printing apparatus including a movable liquid ejection unit; the above-described liquid supply apparatus (4); a medium discharging unit for discharging, in the second direction, a printing medium printed onto by ejecting liquid from the liquid ejection unit; and an operation panel positioned above the medium discharging unit is provided. In this printing apparatus, at least a portion of the liquid tank is positioned on the same side as the medium discharging unit relative to a movement region of the liquid ejection unit that moves in the first direction, and at least a portion of the buffer tank is positioned on an opposite side to the medium discharging unit relative to the movement region.

According to this printing apparatus, it is possible to suppress an increase in the size of the printing apparatus in the first direction that is a direction of movement of the liquid ejection unit. An empty space is often formed in the periphery of the movement region of the liquid ejection unit of the printing apparatus, and thus the liquid tank and the buffer tank can be positioned using this empty space. Furthermore, in this printing apparatus, at least a portion of the liquid tank is positioned on the same side as the medium discharging unit relative to the movement region of the liquid ejection unit, and thus the distance between the liquid tank and the liquid ejection unit is short, and there is an effect in that liquid is easily supplied to the liquid ejection unit.

(11) It may be preferable that the above printing apparatus further includes a scanner unit, and at least a portion of the buffer tank is arranged at a position overlapping a shooting region of the scanner unit.

According to this configuration, at least a portion of the buffer tank is arranged at a position overlapping the shooting region of the scanner unit, and thus it is possible to suppress an increase in the installation area of the printing apparatus.

(12) It may be preferable that the above printing apparatus further includes a waste liquid storage portion that can contain a liquid, and the waste liquid storage portion is positioned below at least a portion of the liquid tank and the buffer tank.

According to this configuration, even when liquid leaks out from the liquid tank and/or the buffer tank, the liquid is likely to be contained in the waste liquid storage portion, and thus there is an effect in that liquid is unlikely to flow to the outside of the printing apparatus.

(13) It may be preferable that the above printing apparatus further includes a section wall that sections between the waste liquid storage portion and at least a portion of the liquid tank and the buffer tank in a height direction, and an opening is provided in a portion of the section wall facing the waste liquid storage portion.

According to this configuration, even when liquid leaks out from the liquid tank and/or the buffer tank, the liquid is likely to be contained in the waste liquid storage portion via the opening in the section wall. In addition, there is an effect in that liquid is unlikely to flow to the outside due to the section wall excluding the opening, between the waste liquid storage portion and the liquid tank and/or the buffer tank.

(14) It may be preferable that the above printing apparatus further includes a section wall that sections between the waste liquid storage portion and at least a portion of the liquid tank and the buffer tank in the height direction, the section wall has an opening, and the opening and the waste liquid storage portion are connected by a liquid guiding member.

According to this configuration, even when liquid leaks out from the liquid tank and/or the buffer tank, the liquid is likely to be contained in the waste liquid storage portion via the opening in the section wall and the liquid guiding member. In addition, the section wall excluding the opening sections between the waste liquid storage portion and the liquid tank and/or the buffer tank, and thus there is an effect in that liquid is unlikely to flow to the outside.

The invention can be realized in various modes other than the above-described liquid supply apparatus and printing apparatus. For example, the invention can be realized in modes such as a liquid supply system and a liquid ejection apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below in the following order.

A. First Embodiment (a mode in which the arrangement direction of liquid tanks and the arrangement direction of buffer tanks are parallel), B. Second Embodiment (a mode in which the arrangement direction of liquid tanks intersects the arrangement direction of buffer tanks), and C. Modified Examples

A. First Embodiment (a Mode in which the Arrangement Direction of Liquid Tanks and the Arrangement Direction of Buffer Tanks are Parallel)

Figure 1:
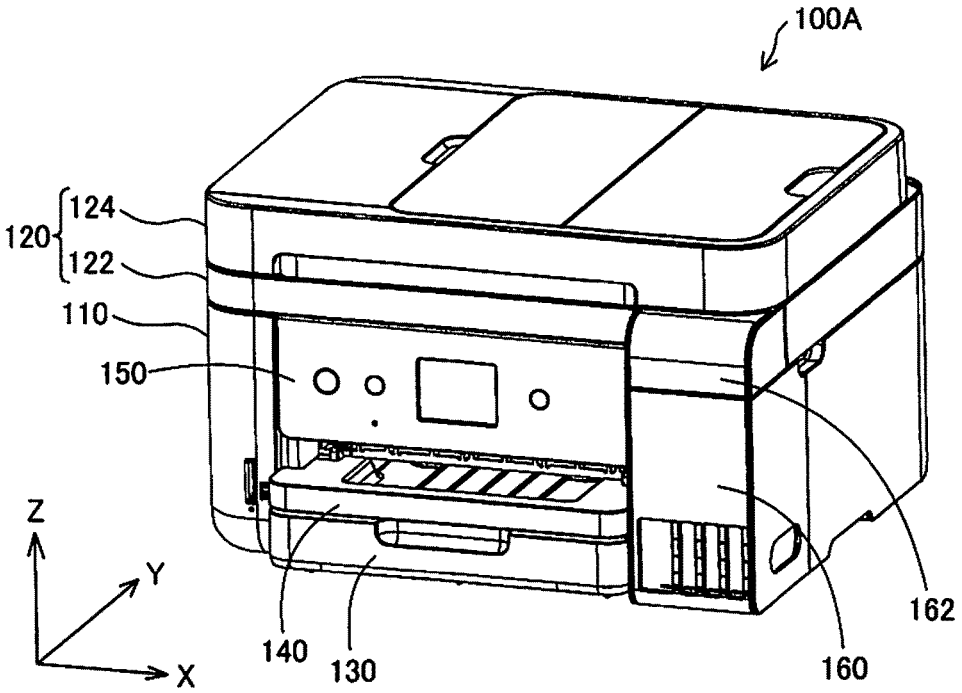
FIG. 1 is a perspective view of a printer of a first embodiment.

FIG. 1 is a perspective view of a printer 100A as a liquid ejection apparatus of a first embodiment. This printer 100A is a printing apparatus that prints by discharging ink as a liquid onto a printing medium. In this specification, "liquid" refers to ink.

In FIG. 1 onward, X, Y, and Z axes orthogonal to each other are illustrated. The X axis corresponds to the width direction of the printer 100A, the Y axis corresponds to the depth direction of the printer 100A, and the Z axis corresponds to the height direction of the printer 100A. The printer 100A is installed on a horizontal installation face defined by an X direction and a Y direction. In this specification, a +X direction is referred to as the "right direction", a −X direction is referred to as the "left direction", a +Y direction is referred to as "rear (direction)", a −Y direction is referred to as "front (direction)", and a t Z direction is referred to as the "vertical direction".

The printer 100A has a printer main body 110, and a scanner unit 120 provided on the printer main body 110 so as to be openable/closable. The scanner unit 120 has a scanner base 122 including a glass plate (not illustrated), and a scanner cover 124. Note that a scanning optical system of the scanner unit 120 is provided in the printer main body 110. In the front face of the printer main body 110, a medium storage unit 130, a medium discharge unit 140, and an operation panel 150 are provided in the stated order from the bottom. The medium storage unit 130 stores a printing medium, and supplies the printing medium to a medium conveyance mechanism (not illustrated). The medium discharge unit 140 discharges, in the −Y direction, a printing medium printed onto by a liquid ejection unit (to be described later) ejecting liquid. A liquid storage unit 160 is provided at the right end (the end portion in the +X direction) of the front face of the printer main body 110. The liquid storage unit 160 has an openable/closable lid 162 thereon.

Figure 2:
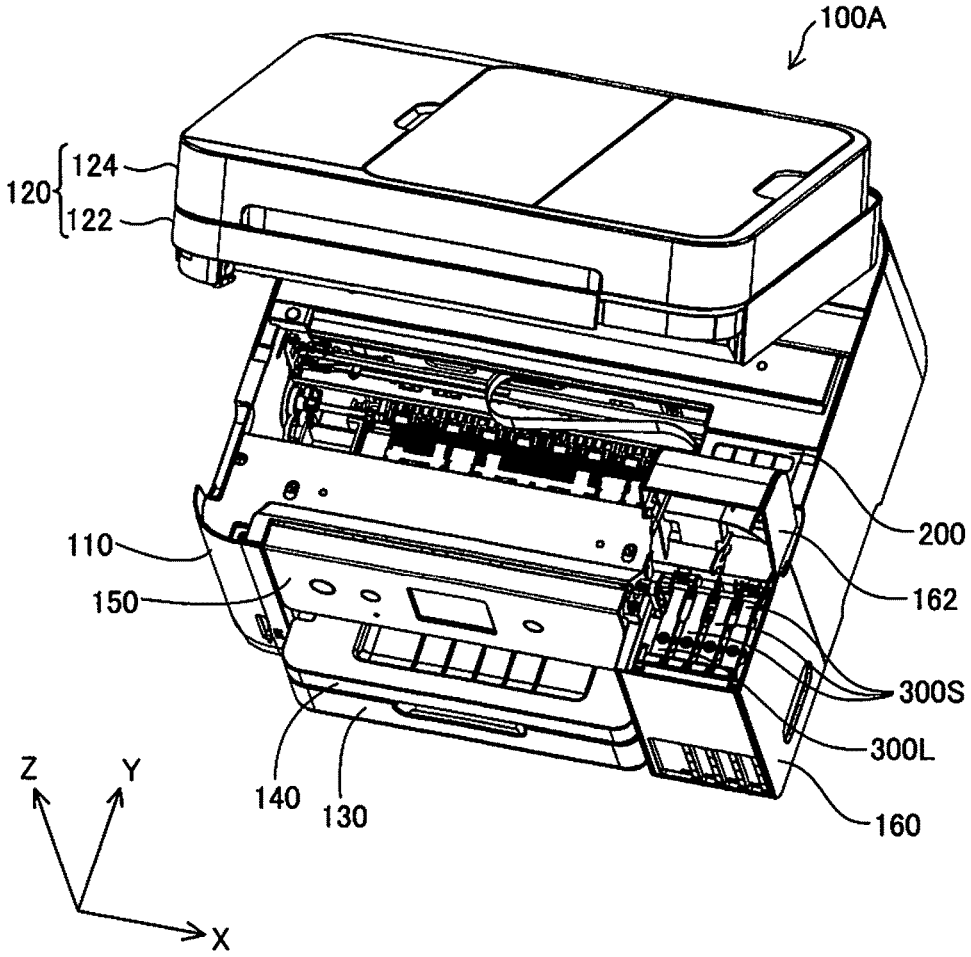
FIG. 2 is a perspective view of the printer of the first embodiment.

FIG. 2 is a perspective view of the printer 100A in a state where the scanner unit 120 and the lid 162 of the liquid storage unit 160 are open. The liquid storage unit 160 stores a plurality of liquid tanks 300S and 300L. The printer main body 110 also has a carriage 200 equipped with the liquid ejection unit (a printing head). This printer 100A is an "off-carriage type" printer in which the liquid tanks 300S and 300L are not mounted on the carriage 200, and the liquid tanks 300S and 300L are installed at fixed positions.

The liquid tanks 300S and 300L can contain ink as a liquid. The liquid tank 300L is a tank that has a larger capacity than the liquid tanks 300S. For example, the liquid tank 300L contains black ink that is consumed in a larger amount, and the liquid tanks 300S contain other ink types (chromatic ink such as magenta ink, cyan ink, and yellow ink). Note that the type of ink and the number of types of ink can be set suitably. In the following description, if two types of liquid tanks consisting of the liquid tanks 300S and 300L do not need to be distinguished apart from each other, they are collectively referred to as "liquid tanks 300". Each liquid tank 300 has a liquid storage chamber (to be described later) that contains a liquid. Any member made of resin, a flexible film or the like can be used as a member constituting the liquid tank 300.

Figure 3:
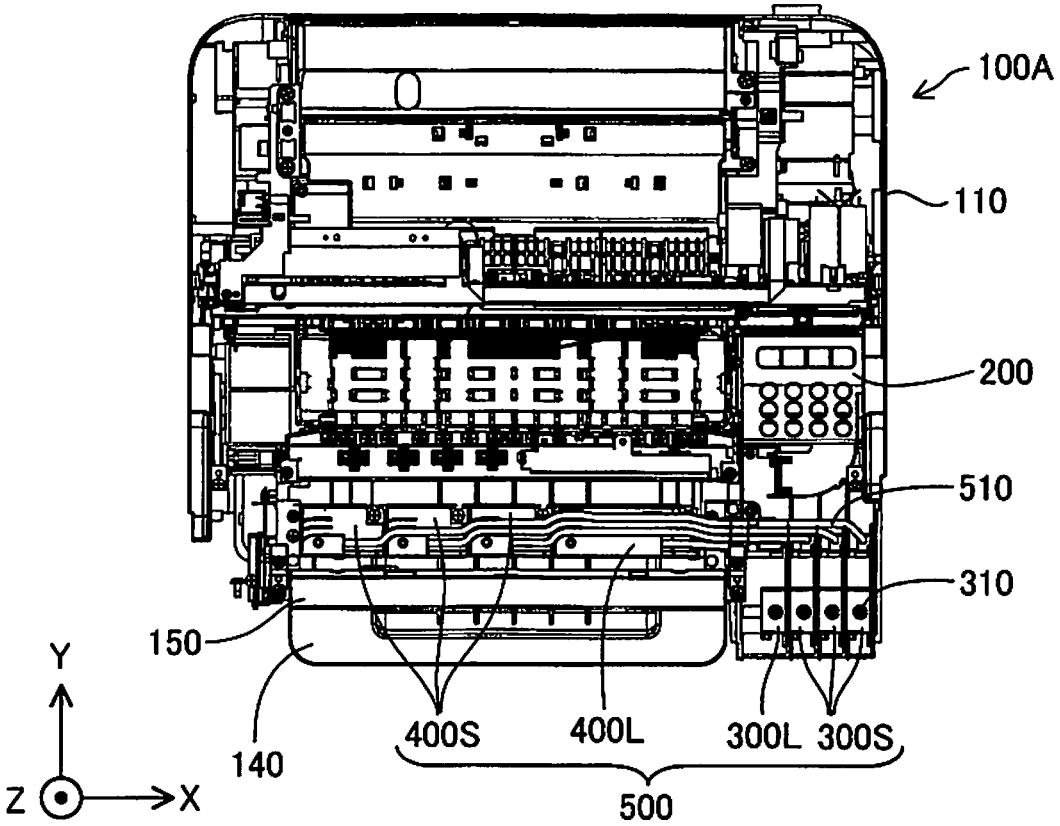
FIG. 3 is a plan view showing the internal structure of the printer of the first embodiment.

FIG. 3 is a plan view showing the internal structure of the printer 100A. Here, some members such as the scanner unit 120 are omitted. A liquid injection portion 310 for injecting liquid into the liquid tank 300 is provided in the upper face of each of the liquid tanks 300. When liquid in the liquid tank 300 is consumed, and the amount of liquid becomes small, the user can replenish liquid via the liquid injection portion 310 using a liquid bottle for replenishing the liquid.

A plurality of buffer tanks 400S and 400L are provided rearward (in the +Y direction of) of the operation panel 150. These buffer tanks 400S and 400L are respectively connected to the liquid tanks 300S and 300L via connection channel members 510. The plurality of liquid tanks 300S and 300L, the plurality of buffer tanks 400S and 400L, and the connection channel members 510 constitute a liquid supply apparatus 500 for supplying liquid to the liquid ejection unit (the printing head) of the printer 100A.

The buffer tank 400L is a tank that has a larger capacity than the buffer tanks 400S, and is connected to the liquid tank 300L that has a larger capacity. The buffer tanks 400S that have a smaller capacity are connected to the liquid tanks 300S that have a smaller capacity. In the following description, if two types of buffer tanks consisting of the buffer tanks 400S and 400L do not need to be distinguished apart from each other, they are collectively referred to as "buffer tanks 400". Each buffer tank 400 has a buffer chamber (to be described later) that contains a liquid that has flowed out from a liquid tank 300. The buffer chamber of the buffer tank 400 is for suppressing leakage of the liquid in the liquid tank 300 to the outside due to environmental changes (change in air pressure, temperature, orientation or the like). As will be described later, the buffer tank 400 has an atmospheric air opening port that is in communication with atmospheric air. Any member made of resin, a flexible film or the like can be used as a member constituting the buffer tank 400.

In the first embodiment, the plurality of liquid tanks 300 are arranged in the X direction (a first direction). In addition, the plurality of buffer tanks 400 are also arranged in the X direction (the first direction). If such an arrangement is adopted, it is possible to suppress an excessive increase in the size of the liquid supply apparatus 500 in a direction (in particular, the Y direction) intersecting the X direction (the first direction).

Note that in this embodiment, the plurality of liquid tanks 300 are formed separately, but instead, a configuration may be adopted in which only one box for the plurality of liquid tanks 300 is provided, and a plurality of liquid storage chambers that contain different types of liquid are provided in the box. In this case, the box and the liquid storage chambers are referred to as a "liquid tank" as a whole. In this specification, the phrase "a liquid tank including a plurality of liquid storage chambers" has a meaning that includes both a case where a plurality of liquid tanks formed separately as in this embodiment are used, and a case where one liquid tank including one box and a plurality of liquid storage chambers is used. Similarly, the phrase "a buffer tank including a plurality of buffer chambers" has a meaning that includes both a case where a plurality of buffer tanks formed separately as in this embodiment are used, and a case where one buffer tank having one box and a plurality of buffer chambers is used.

Channel members with various structures such as tubes, a multi-tube in which a plurality of tubes are joined together in a state of being aligned, and channels made by forming grooves in a base member and sealing the grooves with a film can be used as the connection channel members 510. Various materials such as resin and metal can be used as a material of a member of the connection channel member 510.

In this embodiment, the buffer tanks 400 are connected to the liquid tanks 300, and thus there is the advantage of liquid being unlikely to leak to the outside. Furthermore, the liquid tanks 300 and the buffer tanks 400 are configured separately, and thus there is the advantage of it being easy to increase/decrease the volume of a liquid storage chamber 360 and the volume of a buffer chamber 430 independently.

Figure 4:
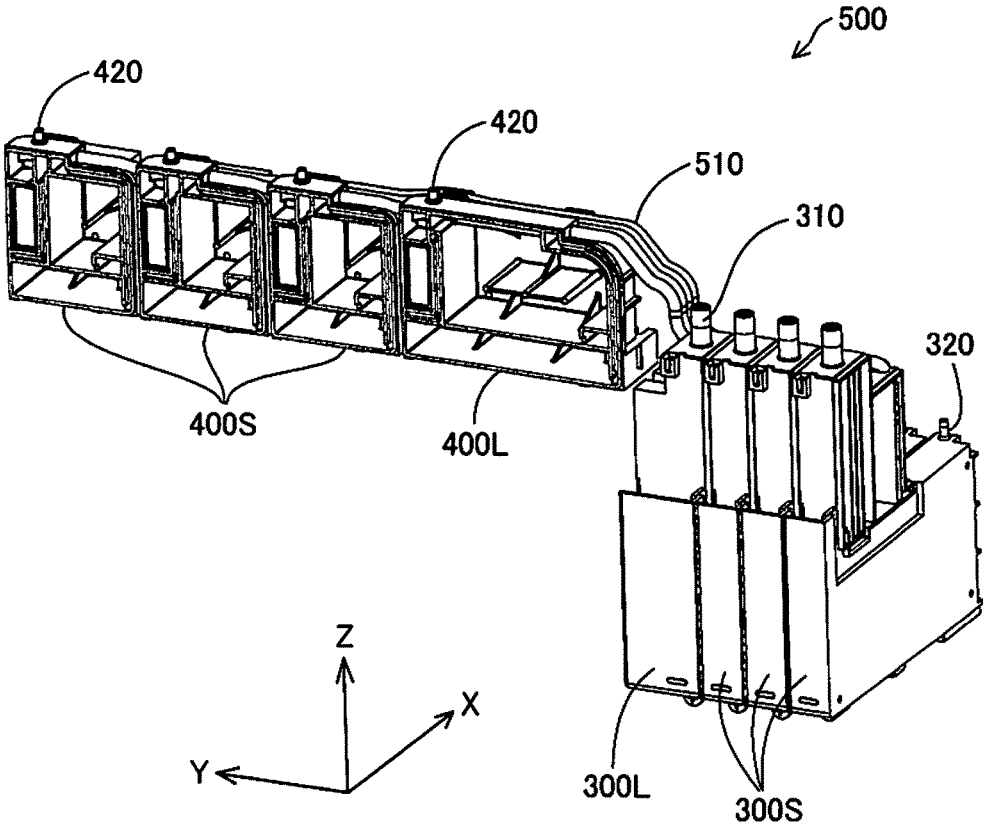
FIG. 4 is a perspective view of a liquid supply apparatus of the first embodiment.
Figure 5:
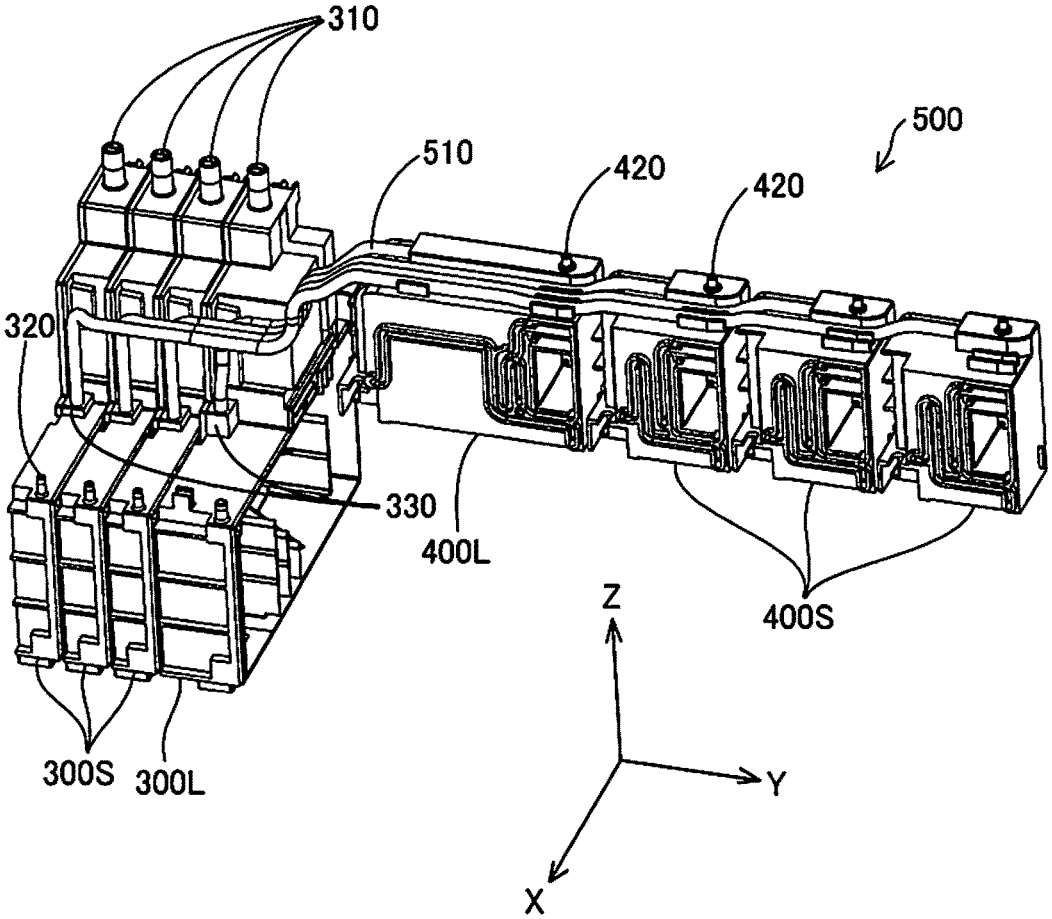
FIG. 5 is a perspective view of the liquid supply apparatus of the first embodiment.

FIGS. 4 and 5 are perspective views of the liquid supply apparatus 500 including the liquid tanks 300, the buffer tanks 400, and the connection channel members 510. Each of the liquid tanks 300 has a connection port 320 for connecting to the liquid ejection unit on the carriage 200 and a connection port 330 for connecting to a buffer tank 400, in addition to the liquid injection portion 310. The connection channel member 510 is connected to the latter connection port 330. Each buffer tank 400 has an atmospheric air opening port 420 in the upper face thereof. The buffer tank 400 is in communication with atmospheric air via this atmospheric air opening port 420.

Figure 6:
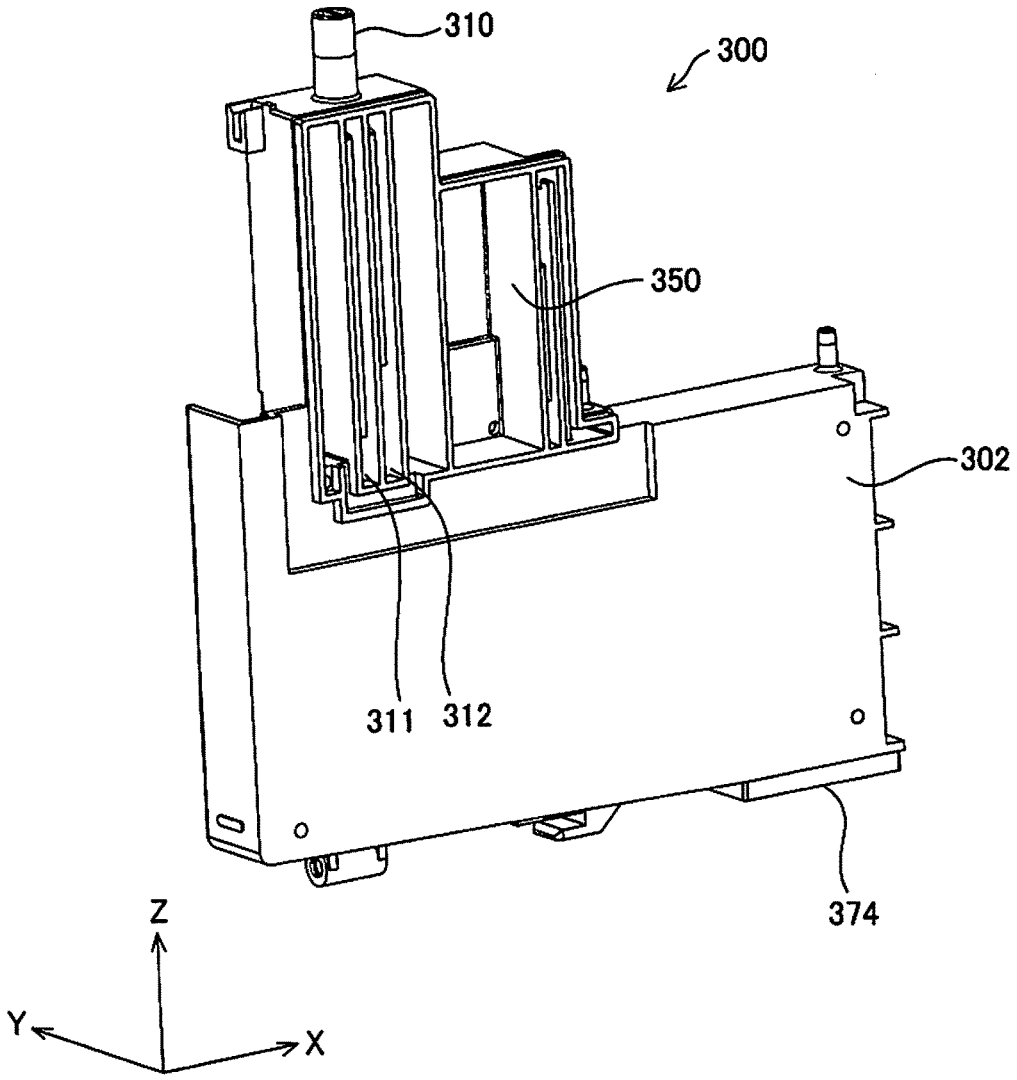
FIG. 6 is a perspective view showing a detailed structure of a liquid tank.
Figure 7:
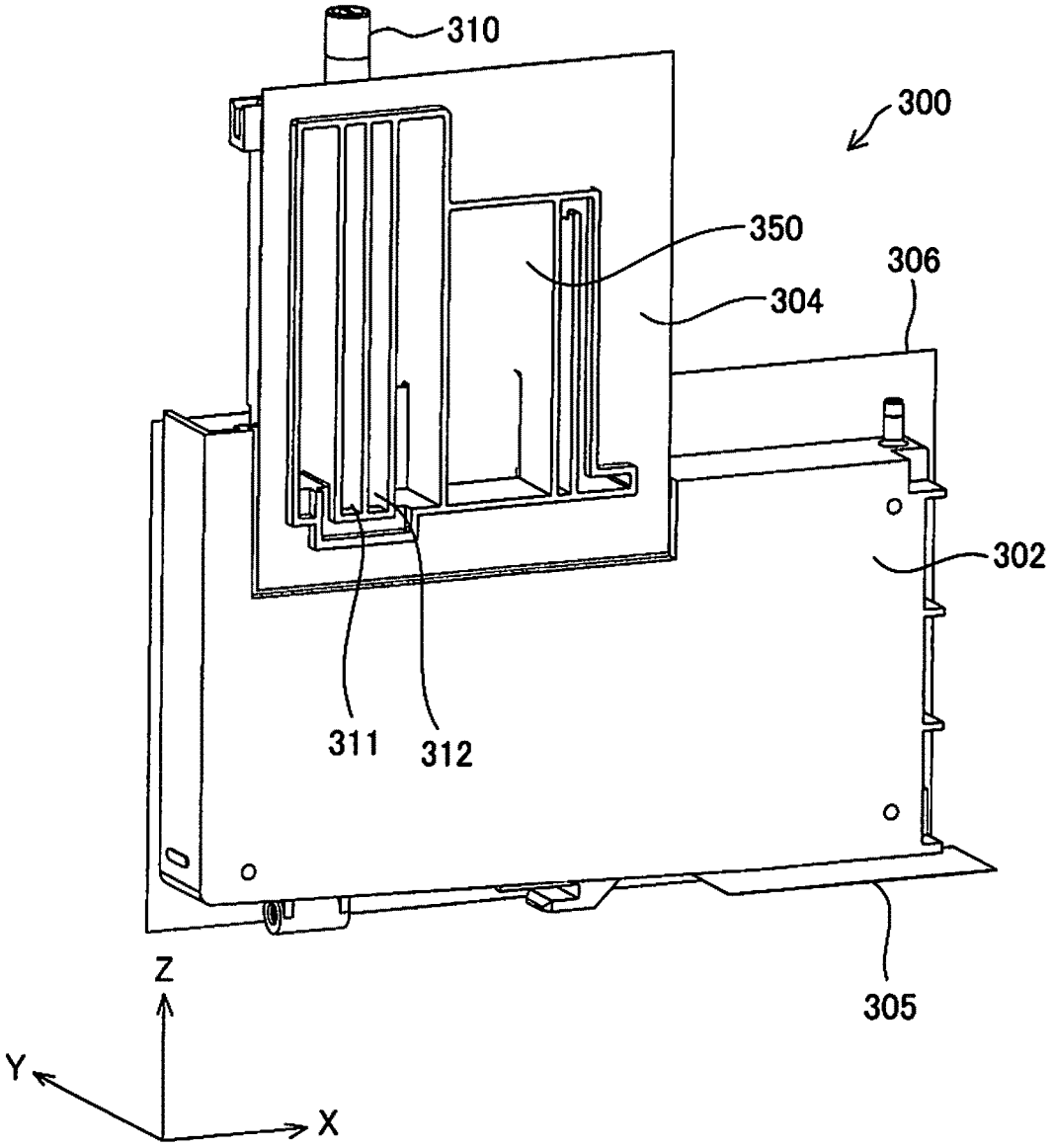
FIG. 7 is a perspective view showing a detailed structure of the liquid tank.
Figure 8:
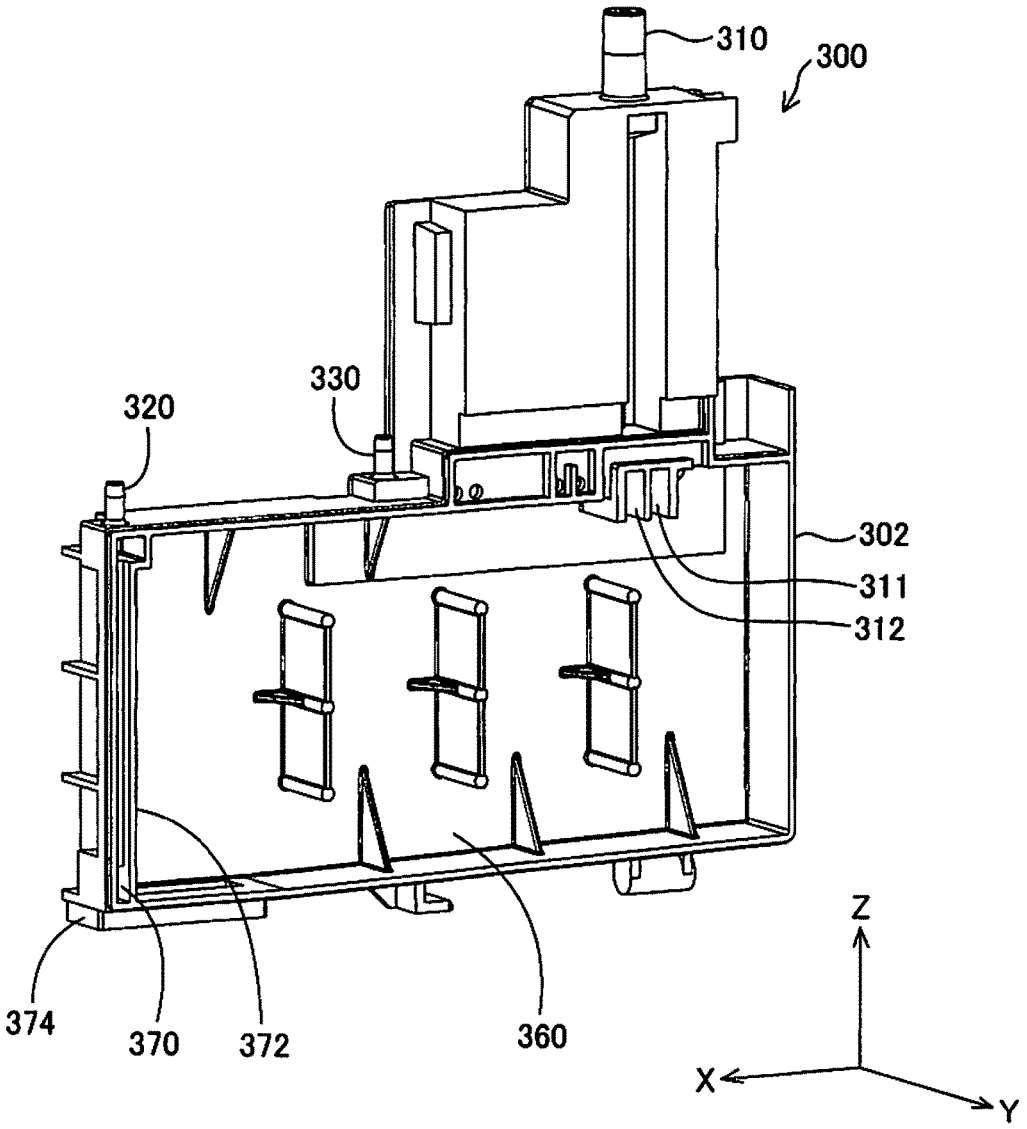
FIG. 8 is a perspective view showing a detailed structure of the liquid tank.
Figure 9:
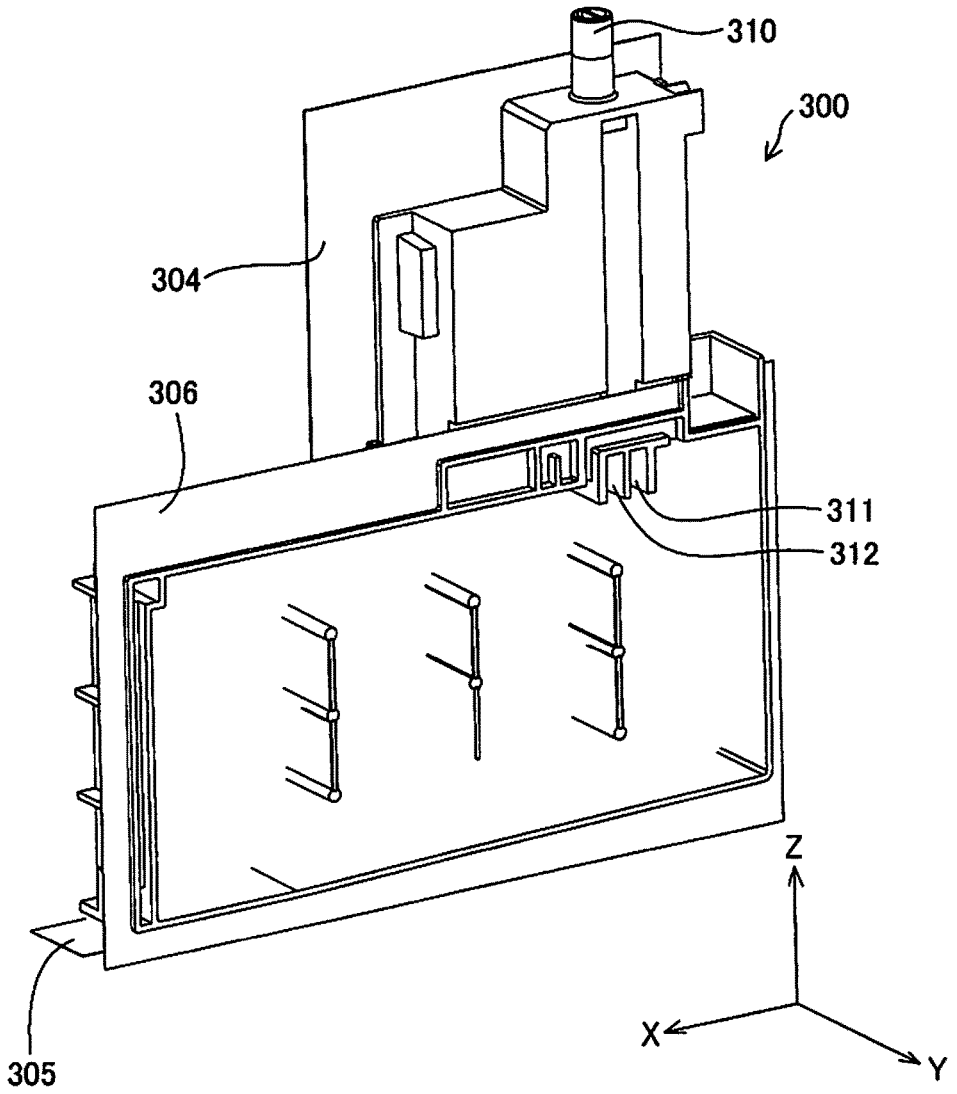
FIG. 9 is a perspective view showing a detailed structure of the liquid tank.

FIGS. 6 to 9 are perspective views showing a detailed structure of the liquid tank 300. FIGS. 6 and 7 show a first side face of a main body 302 of the liquid tank 300, where FIG. 6 shows a state where liquid-impermeable films 304 to 306 are not attached to the main body 302, and FIG. 7 shows a state where the films 304 to 306 are attached to the main body 302. FIGS. 8 and 9 show a second side face of the main body 302 of the liquid tank 300, where FIG. 8 shows a state where the films 304 to 306 are not attached to the main body 302, and FIG. 9 shows a state where the films 304 to 306 are attached to the main body 302. Note that in these examples, the films 304 to 306 are transparent.

Two liquid introduction paths 311 and 312 separated from each other are formed inside the liquid injection portion 310. The lower ends of the liquid introduction paths 311 and 312 (i.e., the lower end of the liquid injection portion 310) are open to the liquid storage chamber 360 (FIG. 8) that is in the lower portion of the liquid tank 300. When replenishing liquid to the liquid storage chamber 360, the connection port of a liquid bottle for replenishment is placed at the opening of the liquid injection portion 310, and liquid is injected from the liquid bottle. At this time, one of the two liquid introduction paths 311 and 312 functions as a discharge path for discharging air from the liquid tank 300 to the liquid bottle, and the other functions as an injection path for the liquid. As a result, the liquid is replenished to the liquid storage chamber 360 using air-liquid exchange. When the liquid level in the liquid storage chamber 360 rises to the lower end of the liquid injection portion 310, air-liquid exchange is disabled and replenishment ends. Therefore, the maximum liquid level in the liquid storage chamber 360 is at the height of the lower end of the liquid injection portion 310. Note that if a liquid is not being replenished, the opening in the upper portion of the liquid injection portion 310 is sealed by a cap.

An upper air chamber 350 is provided lateral to the liquid injection portion 310. This upper air chamber 350 is in communication with an upper portion of the liquid storage chamber 360. In the state in FIG. 6, the liquid introduction paths 311 and 312 of the liquid injection portion 310 and the upper air chamber 350 are open to the outside, but in the state in FIG. 7, those openings are sealed by the film 304. Similarly, in the state in FIG. 8, the liquid storage chamber 360 is also open to the outside, but in the state in FIG. 9, the opening is sealed by the film 306.

The connection port 330 for connecting to a buffer tank 400 is provided in the upper wall portion of the liquid storage chamber 360. In addition, the connection port 320 for connecting to the liquid ejection unit mounted on the carriage 200 is provided at one end portion of the upper wall portion of the main body 302. A liquid supply path 370 partitioned from the liquid storage chamber 360 by a partition wall 372 is formed below this connection port 320. This liquid supply path 370 is in communication with the liquid storage chamber 360 via a communication path 374 provided in a state of being open at the bottom wall of the main body 302. In the state of FIGS. 7 and 9, the opening in the lower portion of the communication path 374 is sealed by the film 305.

Figure 10:
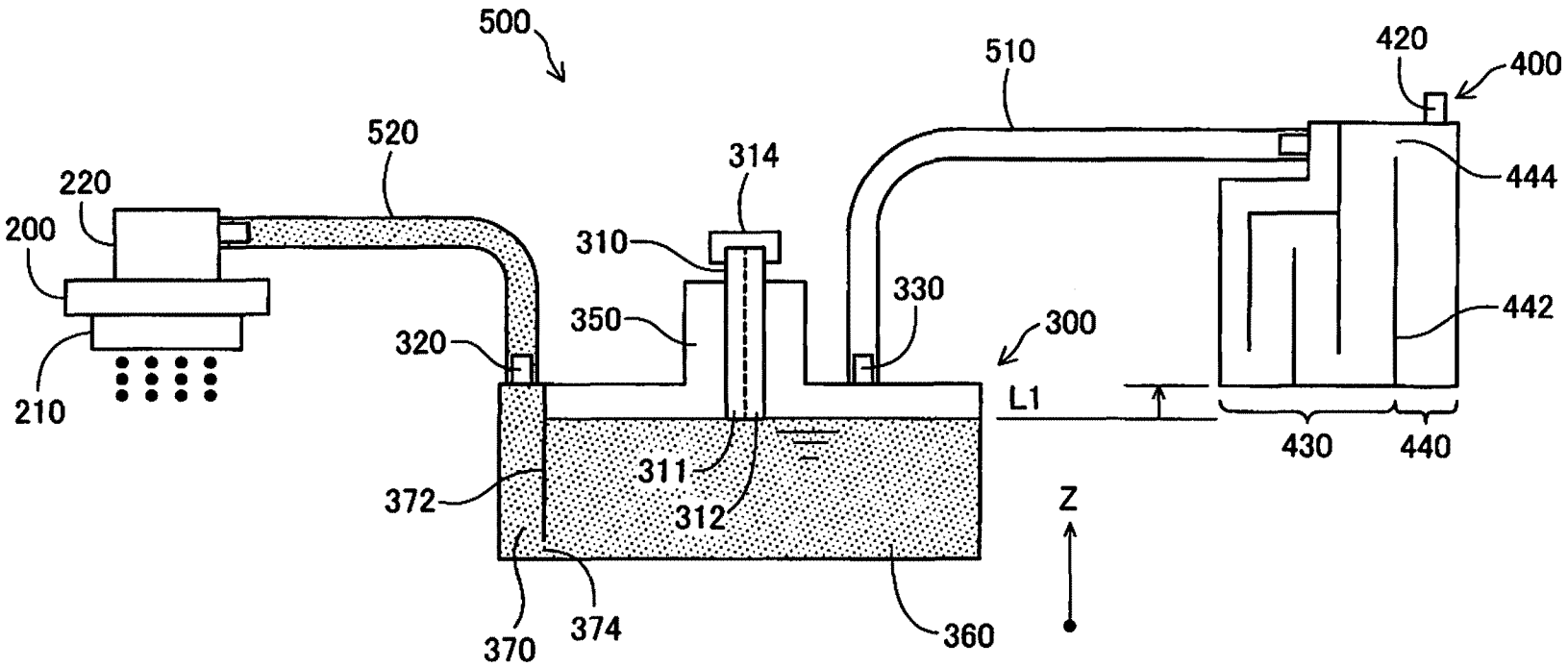
FIG. 10 is a schematic view showing a connection relationship between the liquid supply apparatus and a carriage.

FIG. 10 is a schematic view showing the connection relationship between the liquid supply apparatus 500 and the carriage 200. Here, the X direction and the Y direction are omitted, and only a Z direction (the up-down direction) is illustrated using an arrow. In addition, the structures of a liquid tank 300 and a buffer tank 400 are illustrated in a simplified manner.

The carriage 200 is equipped with a liquid ejection unit 210 and a sub tank 220. The sub tank 220 is connected to the liquid tank 300 via a connection channel member 520. In addition, the sub tank 220 is connected to the liquid ejection unit 210 via a channel (not illustrated). The liquid ejection unit 210 is a so-called printing head, and can move together with the carriage 200. The liquid ejection unit 210 executes printing by ejecting a liquid onto a printing medium while the carriage 200 is moving. A certain amount of liquid supplied from the liquid tank 300 is stored in the sub tank 220, and is supplied from the sub tank 220 to the liquid ejection unit 210. Note that the sub tank 220 may be omitted.

A maximum liquid level L1 (also referred to as a "first liquid level L1") is set in the liquid storage chamber 360 of the liquid tank 300. As described above, this maximum liquid level L1 is a liquid level at which air-liquid exchange is disabled when liquid is replenished, and is the same as the height of the lower end of the liquid injection portion 310. The space above the maximum liquid level L1 functions as the upper air chamber 350. However, the internal structure of the liquid tank 300 may be changed such that the maximum liquid level L1 is set using a method different from the method of this embodiment. For example, a structure may be adopted in which the liquid tank 300 is made of a transparent or semi-transparent member such that the liquid level can be observed from the outside, and the maximum liquid level L1 is displayed in the internal or external face of the liquid tank 300. In both these cases, the maximum liquid level L1 functions as an indicator of the upper limit of the amount of liquid that is contained in the liquid tank 300. Note that the opening of the liquid injection portion 310 is closed using a cap 314.

The connection port 330 for connecting the liquid tank 300 to the buffer tank 400 is provided at a position higher than the maximum liquid level L1 (i.e., a wall of the upper air chamber 350). With such a configuration, there is the advantage of the liquid in the liquid storage chamber 360 being unlikely to flow out to the buffer tank 400.

The buffer tank 400 is connected to the liquid tank 300 via a connection channel member 510. The buffer chamber 430 and an air chamber 440 are provided inside the buffer tank 400. The air chamber 440 is provided with an atmospheric air opening port 420. The atmospheric air opening port 420 is preferably provided in the upper wall of the air chamber 440. The buffer chamber 430 contains liquid that has flowed out from the liquid tank 300 into the buffer tank 400 via the connection channel member 510. A portion of the buffer chamber 430 has a maze-like structure, and is partitioned from the air chamber 440 by a partition wall 442. However, an opening 444 is provided in an upper portion of the partition wall 442, and the buffer chamber 430 and the air chamber 440 are communication with each other via this opening 444. With this configuration, liquid does not leak out to the air chamber 440 unless the liquid reaches the upper portion of the buffer chamber 430, and thus there is the advantage of liquid being unlikely to flow out from the atmospheric air opening port 420 to the outside. Note that when liquid in the liquid tank 300 is consumed in a normal state, air is replenished from the buffer tank 400 as the liquid is consumed. Accordingly, the buffer tank 400 constitutes a portion of an atmospheric air communication path that allows the liquid storage chamber 360 to be in communication with atmospheric air.

The volume of the buffer chamber 430 is determined in consideration of the amount of liquid in the liquid storage chamber 360 that may flow out from the liquid storage chamber 360 due to an environmental change (change in air pressure, temperature, orientation and the like). For example, the volume of the buffer chamber 430 is set to be in a range of 25% to 80% of the volume of the liquid storage chamber 360.

The buffer tank 400 is installed such that the bottom face of the buffer chamber 430 is at a position higher than the maximum liquid level L1 of the liquid tank 300. With such a configuration, there is the advantage of liquid being unlikely to flow out from the liquid storage chamber 360 to the buffer chamber 430. In addition, liquid that has flowed out from the liquid storage chamber 360 to the buffer chamber 430 is likely to return to the liquid storage chamber 360, and thus the amount of unused liquid can be reduced.

In this embodiment, the entirety of the connection channel member 510 that connects the liquid tank 300 and the buffer tank 400 is held higher than the maximum liquid level L1 of the liquid tank 300. With such a configuration, there are the advantages of liquid being unlikely to flow out from the liquid storage chamber 360 to the buffer chamber 430, and the liquid being likely to return from the buffer chamber 430 to the liquid storage chamber 360. Furthermore, there is the advantage of the connection channel member 510 being easy to mount when manufacturing the liquid supply apparatus 500. In addition, the connection port 330 for connecting a liquid tank 300 to the buffer tank 400 is provided in the upper air chamber 350, and thus there is the advantage of liquid being unlikely to flow out from the liquid tank 300 even when the atmospheric temperature rises, and the internal pressure of the liquid tank 300 rises.

Figure 11:
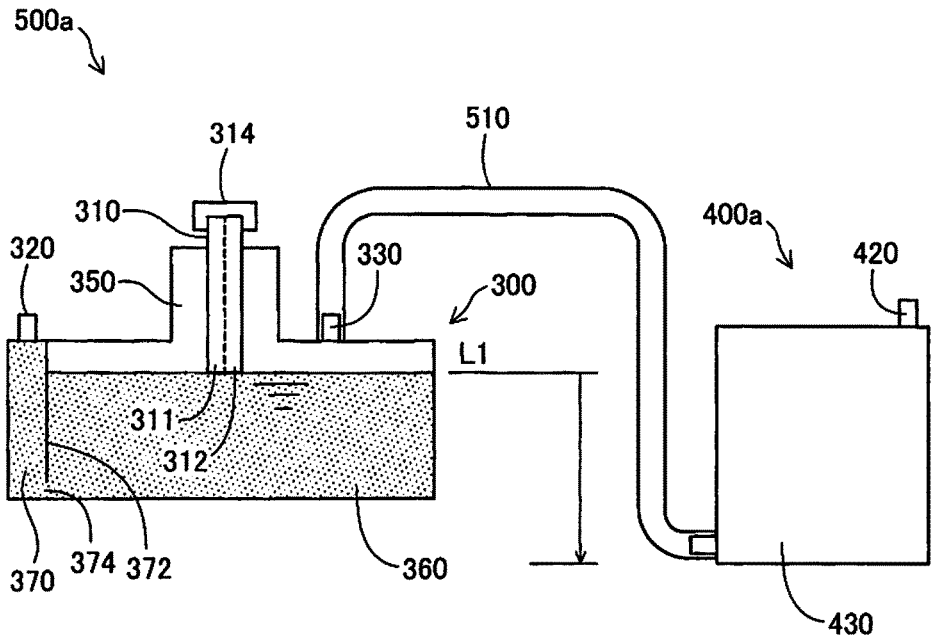
FIG. 11 is a schematic view showing a modified example of the liquid supply apparatus.

FIG. 11 is a schematic view showing a modified example of the liquid supply apparatus 500. Here, the carriage 200 and the connection channel member 520 of the carriage 200, which are illustrated in FIG. 10, are omitted. A liquid supply apparatus 500*a* in FIG. 11 has the following differences from the liquid supply apparatus 500 shown in FIG. 10, but is otherwise the same.

(1) The buffer tank 400*a* is installed such that the bottom face of the buffer chamber 430 is at a position lower than the maximum liquid level L1 of the liquid tank 300, (2) the inside of the buffer tank 400*a* is not partitioned into the buffer chamber 430 and the air chamber 440 (FIG. 10), and the buffer chamber 430 functions as an air chamber as well, and (3) the connection channel member 510 connects the liquid tank 300 and the buffer tank 400*a* via a position higher than the maximum liquid level L1 of the liquid tank 300

According to this liquid supply apparatus 500*a*, the connection channel member 510 connects the liquid tank 300 and the buffer tank 400*a* via a position higher than the maximum liquid level L1 (the first liquid level), and thus there is the advantage of liquid being unlikely to flow out from the liquid storage chamber 360 to the buffer chamber 430. In addition, the connection port 330 for connecting the liquid tank 300 to the buffer tank 400*a* is provided at a position higher than the maximum liquid level L1 (the first liquid level), and thus there is the advantage of liquid being unlikely to flow out from the liquid tank 300 even when the atmospheric temperature rises, and the internal pressure of the liquid tank 300 rises.

Figure 12:
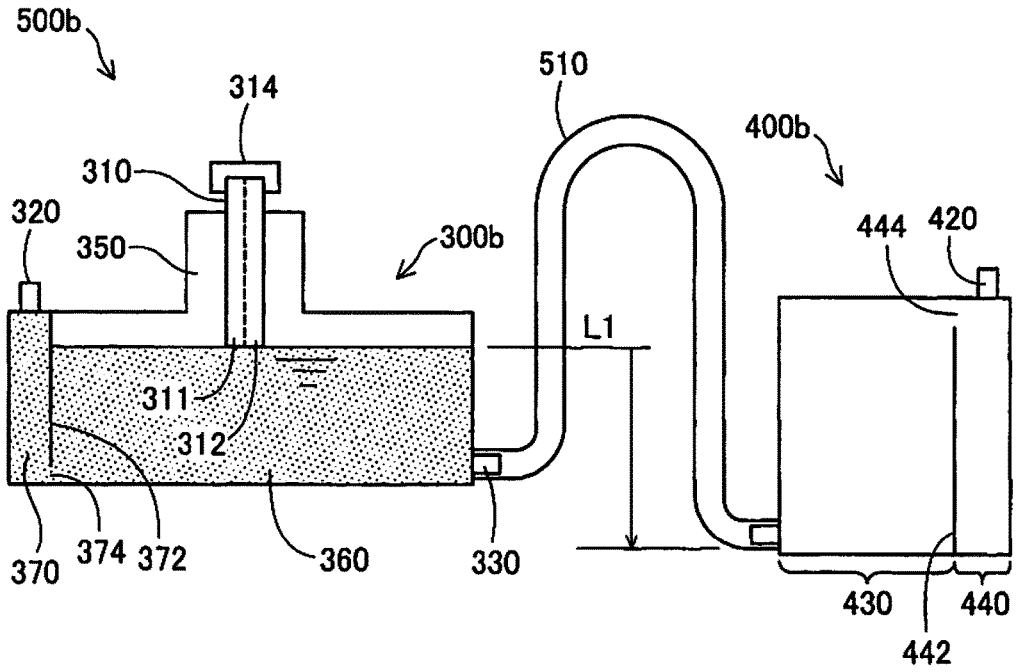
FIG. 12 is a schematic view showing another modified example of the liquid supply apparatus.

FIG. 12 is a schematic view showing another modified example of the liquid supply apparatus 500. A liquid supply apparatus 500*b* in FIG. 12 has the following differences from the liquid supply apparatus 500*a* shown in FIG. 11, and is otherwise the same.

(1) The connection port 330 for connecting a liquid tank 300*b* to a buffer tank 400*b* is provided at a position lower than the maximum liquid level L1 (the first liquid level), and (2) the inside of the buffer tank 400*b* is partitioned into the buffer chamber 430 and the air chamber 440 by the partition wall 442, and the buffer chamber 430 and the air chamber 440 are in communication with each other by the opening 444 provided in the upper portion of the partition wall 442

The liquid supply apparatus 500*b* in FIG. 12 is the same as the modified example shown in FIG. 11 in that the connection channel member 510 connects the liquid tank 300 and the buffer tank 400*b* via a position higher than the maximum liquid level L1 of the liquid tank 300. Therefore, there is the advantage of liquid being unlikely to flow out from the liquid storage chamber 360 to the buffer chamber 430.

Figure 13:
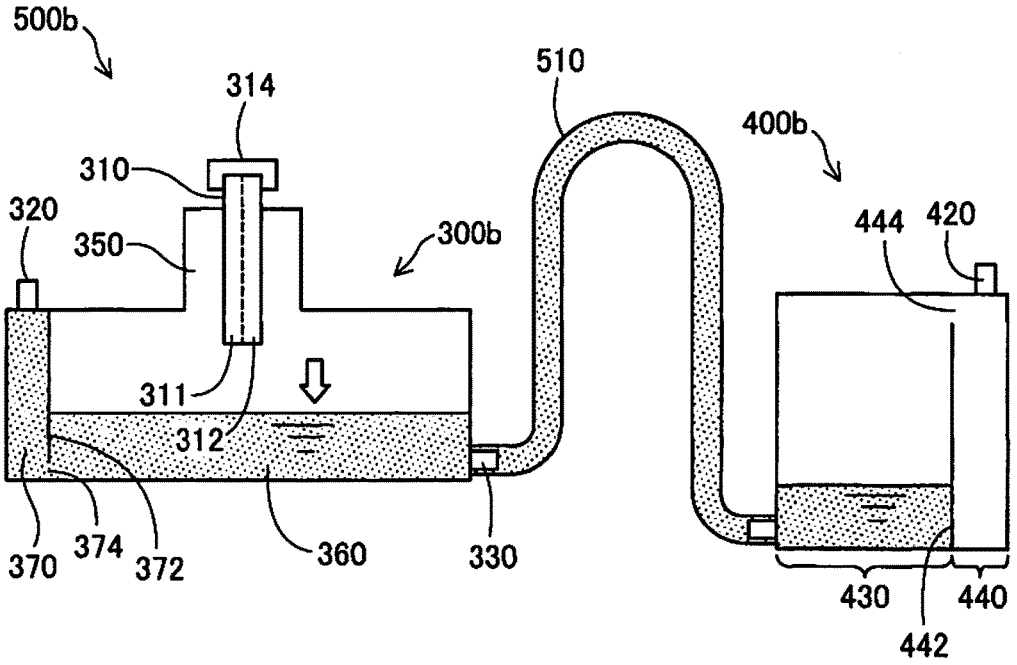
FIG. 13 is a schematic view showing another modified example of the liquid supply apparatus.

FIG. 13 shows a state where the internal pressure of the liquid tank 300*b* has risen from the state in FIG. 12, and liquid has flowed from the liquid tank 300*b* to the buffer chamber 430. When liquid flows out from the liquid tank 300*b*, the internal pressure decreases, and thus the liquid stops leaking out when the internal pressure of the liquid tank 300*b* is at a negative pressure. Also in this case, the air chamber 440 of the buffer tank 400*b* is partitioned from the buffer chamber 430 by the partition wall 442, and thus it is possible to reduce the possibility of liquid leaking out from the atmospheric air opening port 420 to the outside. In addition, the opening 444 that allows the buffer chamber 430 and the air chamber 440 to be in communication with each other is provided in an upper portion of the partition wall 442, and thus liquid does not leak out to the air chamber 440 unless the liquid reaches an upper portion of the buffer chamber 430. As a result, there is the advantage of liquid being unlikely to flow out from the atmospheric air opening port 420 to the outside.

Note that the buffer tank 400 shown in FIG. 10 may be adopted in the modified examples in FIG. 11 to FIG. 13. In the following description, if the buffer tank 400, 400*a*, and 400*b* do not need to be distinguished apart from each other, they are simply referred to as "buffer tanks 400".

Figure 14:
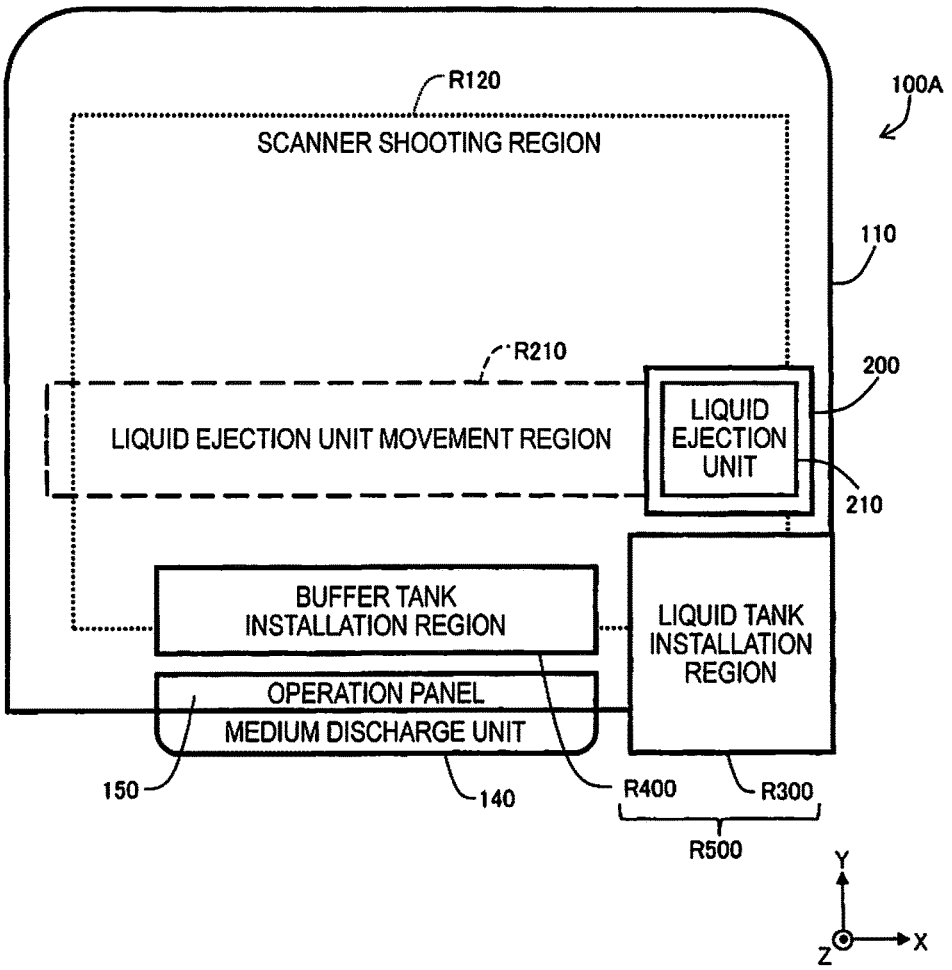
FIG. 14 is an explanatory view showing a plane arrangement of constituent elements of the printer of the first embodiment.

FIG. 14 is an explanatory view showing the plane arrangement of constituent elements of the printer 100A of the first embodiment. As described above, the medium discharge unit 140 and the operation panel 150 are provided in the front face of the printer main body 110. The liquid tanks 300 are installed lateral to the medium discharge unit 140 and the operation panel 150. In addition, the buffer tanks 400 are installed rearward (in the +Y direction of) of the operation panel 150. Here, a region in which the liquid tanks 300 are installed is illustrated as a "liquid tank installation region R300", and a region in which the buffer tanks 400 are installed is illustrated as a "buffer tank installation region R400". The liquid supply apparatus 500 (FIG. 3) includes the liquid tanks 300 and the buffer tanks 400, and thus the liquid tank installation region R300 and the buffer tank installation region R400 constitute a portion of an installation region R500 of the liquid supply apparatus 500.

The carriage 200 equipped with the liquid ejection unit 210 is illustrated rearward of the liquid tank installation region R300. The carriage 200 reciprocally moves along the X direction. Therefore, a movement region R210 in which the liquid ejection unit 210 moves is a region longer in the X direction. In addition, this liquid ejection unit movement region R210 is rearward of the liquid tank installation region R300 and the buffer tank installation region R400.

The scanner unit 120 (FIG. 1) can form an image by scanning an image in a scanner shooting region R120 shown in FIG. 14. In this example, the scanner shooting region R120 is a region that includes a portion of the liquid ejection unit movement region R210, a portion of the liquid tank installation region R300, and a portion of the buffer tank installation region R400.

The regions in FIG. 14 are regions of the printer 100A when projected and observed from above. In this figure, when the structure of the printer 100A excluding the liquid supply apparatus 500 is projected from above, at least a portion of the liquid supply apparatus 500 (i.e., the installation region R500 thereof) is included inside the outer periphery of the printer 100A. If a portion or the entirety of the liquid supply apparatus 500 is provided inside of the outer periphery of the printer main body 110 in this manner instead of providing the entirety of the liquid supply apparatus 500 out of the printer 100A, there is the advantage of being able to suppress an excessive increase in the installation area of the printer 100A.

In FIG. 14, the liquid tanks 300 are arranged on the same side as the medium discharge unit 140 relative to the liquid ejection unit movement region R210, and the buffer tanks 400 are arranged between the operation panel 150 and the liquid ejection unit movement region R210. If such arrangement is adopted, it is possible to suppress an increase in the size of the printer 100A in the discharge direction of a printing medium (the −Y direction). In addition, an empty space is often formed in the periphery of the liquid ejection unit movement region R210, and thus if the above-described arrangement is adopted, the liquid tanks 300 and the buffer tanks 400 can be arranged using this empty space. Furthermore, in this printer 100A, the liquid tanks 300 are arranged on the same side as the medium discharge unit 140 relative to the liquid ejection unit movement region R210, and thus the distance between the liquid tanks 300 and the liquid ejection unit 210 is short, and there is the advantage of it being easy to supply liquid to the liquid ejection unit 210.

Note that only some of the liquid tanks 300 may be arranged on the same side as the medium discharge unit 140 relative to the liquid ejection unit movement region R210 instead of arranging all the liquid tanks 300 on the same side as the medium discharge unit 140 relative to the liquid ejection unit movement region R210. In addition, only some of the buffer tanks 400 may be arranged between the operation panel 150 and the liquid ejection unit movement region R210 instead of arranging all the buffer tanks 400 between the operation panel 150 and the liquid ejection unit movement region R210. Also in these cases, advantages similar to the above advantages are acquired.

In FIG. 14, furthermore, the buffer tanks 400 are arranged at a position overlapping the scanner shooting region R120. If such an arrangement is adopted, it is possible to suppress an increase the installation area of the printer 100A. Note that only some of the buffer tanks 400 may be arranged at a position overlapping the scanner shooting region R120 instead of arranging all the buffer tanks 400 at a position overlapping the scanner shooting region R120. Also in this case, similarly, it is possible to suppress an increase in the installation area of the printer 100A.

As described above, in the first embodiment, the buffer tank 400 is connected to the liquid tank 300, and thus there is an effect in that liquid is unlikely to leak to the outside. In addition, as described with reference to FIG. 10, if the bottom face of the buffer chamber 430 of the buffer tank 400 is at a position higher than the maximum liquid level L1 of the liquid tank 300, an effect in that liquid is unlikely to flow out from the liquid storage chamber 360 to the buffer chamber 430 is acquired. In addition, liquid that has flowed out from the liquid storage chamber 360 to the buffer chamber 430 is likely to return to the liquid storage chamber 360, and thus the amount of unused liquid can be reduced. Furthermore, the liquid tank 300 and the buffer tank 400 are configured separately, and thus there is an effect in that it is easy to increase/decrease the volume of the liquid storage chamber 360 and the volume of the buffer chamber 430 independently.

In addition, in the first embodiment, a plurality of liquid tanks 300 are arranged in the X direction (the first direction), and a plurality of buffer tanks 400 are also arranged in a direction parallel to the X direction (the first direction). If such an arrangement is adopted, it is possible to suppress an excessive increase in the size of the liquid supply apparatus 500 in a direction intersecting the X direction (the first direction).

Note that the configurations of the liquid supply apparatuses 500*a* and 500*b* described with reference to FIGS. 11 to 13 may be adopted as the configuration of the liquid supply apparatus 500 instead of adopting a configuration in which the bottom face of the buffer chamber 430 of the buffer tank 400 is at a position higher than the maximum liquid level L1 of the liquid tank 300. Specifically, the buffer tank 400 may be installed such that the bottom face of the buffer chamber 430 of the buffer tank 400 is positioned lower than the first liquid level L1 set as an indicator of the upper limit of the amount of liquid that is contained in the liquid tank 300. In this case, the connection channel member 510 preferably connects the liquid tank 300 and the buffer tank 400 via a position higher than the first liquid level L1. According to these liquid supply apparatuses 500*a* and 500*b*, the connection channel member 510 connects the liquid tank 300 and the buffer tank 400 via a position higher than the first liquid level L1, and thus an effect that liquid is unlikely to flow out from the liquid storage chamber 360 to the buffer chamber 430 is achieved.

B. Second Embodiment (a Mode in which the Arrangement Direction of Liquid Tanks Intersects the Arrangement Direction of Buffer Tanks)

Figure 15:
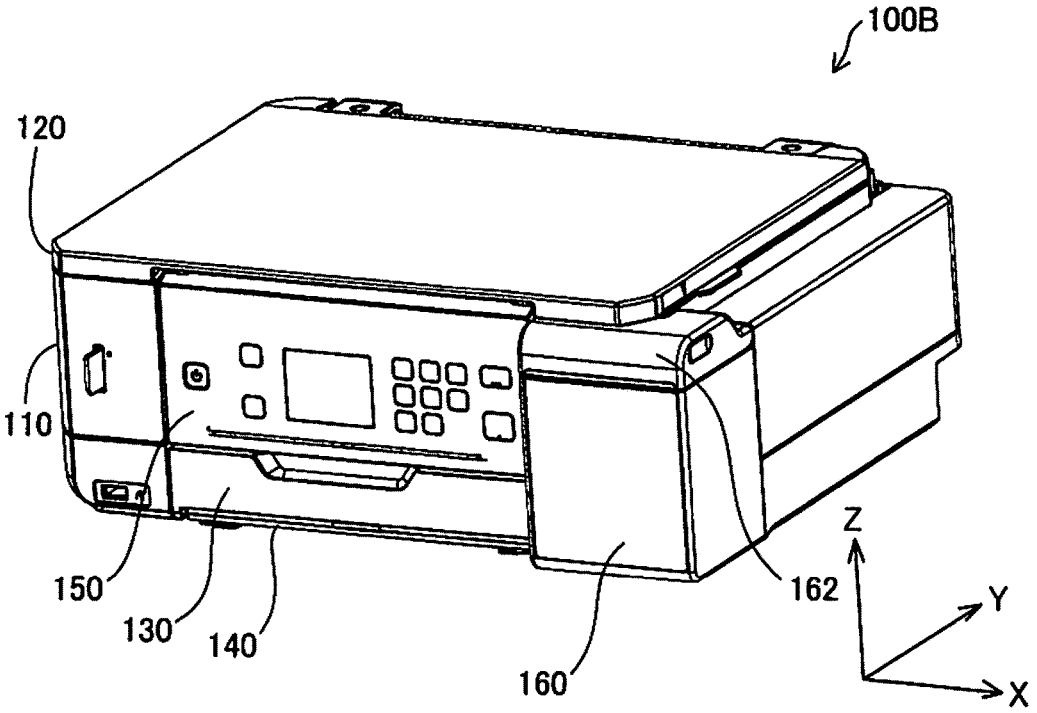
FIG. 15 is a perspective view of a printer of a second embodiment.
Figure 16:
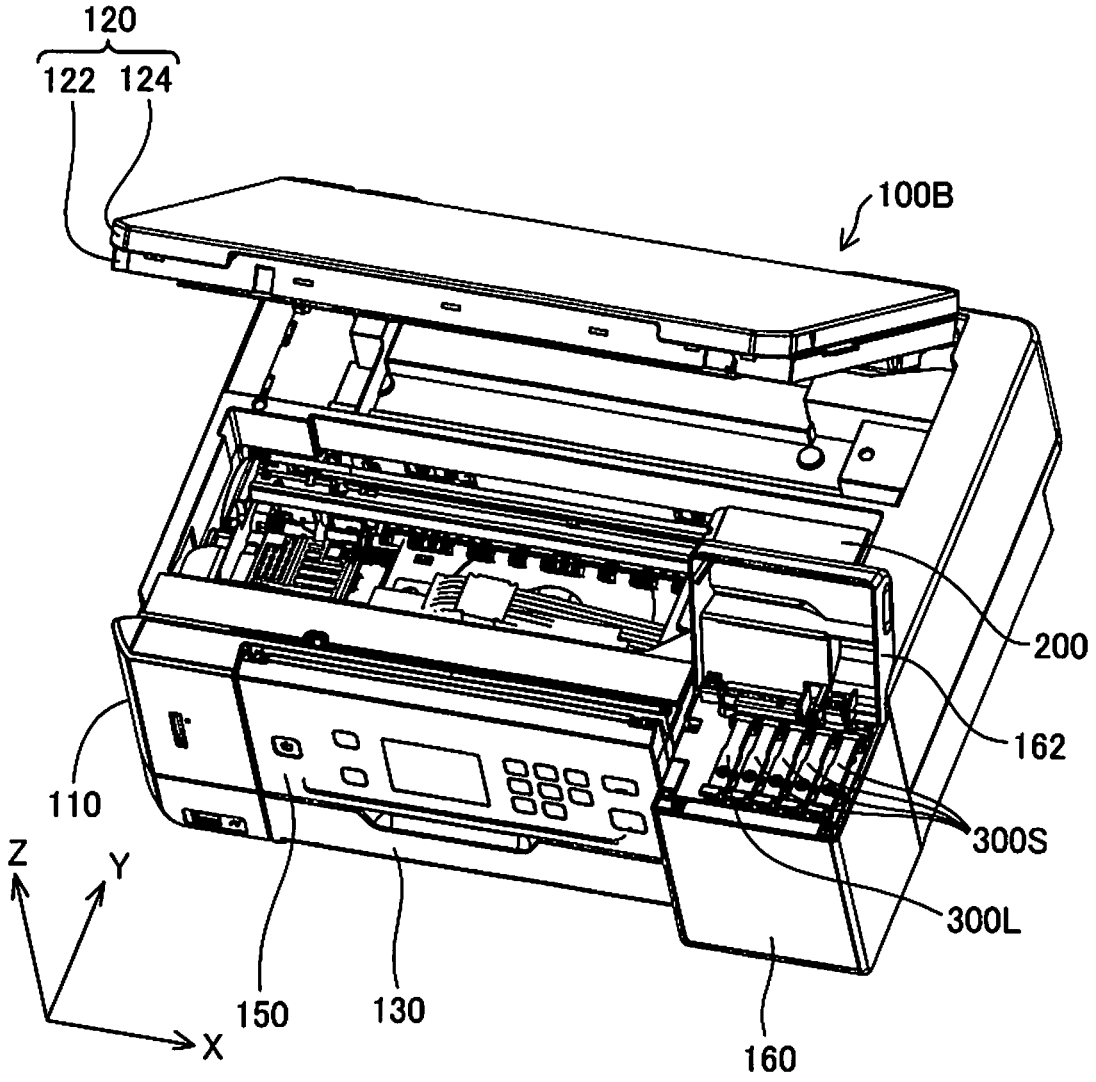
FIG. 16 is a perspective view of the printer of the second embodiment.

FIG. 15 is a perspective view of a printer 100B as a liquid ejection apparatus of a second embodiment, and FIG. 16 shows a state where a scanner unit 120 and a lid 162 of a liquid storage unit 160 are open. Note that constituent elements constituting the printer 100B have somewhat different structures from the constituent elements constituting the printer 100A of the first embodiment, but will be described below using the same reference numerals for corresponding constituent elements for convenience.

Similarly to the printer 100A of the first embodiment, this printer 1008 is also provided with a printer main body 110 and a scanner unit 120 provided on the printer main body 110 so as to be openable/closable. The scanner unit 120 has a scanner base 122 including a glass plate (not illustrated), and a scanner cover 124. Note that a scanning optical system of the scanner unit 120 is provided in the printer main body 110. In the front face of the printer main body 110, a medium discharge unit 140, a medium storage unit 130, and an operation panel 150 are provided in the stated order from the bottom. The medium storage unit 130 stores a printing medium, and supplies the printing medium to a medium conveyance mechanism (not illustrated). The medium discharge unit 140 discharges, in the −Y direction, a printing medium printed onto by a liquid ejection unit (to be described later) ejecting liquid. The liquid storage unit 160 is provided at the right end (the end portion in the +X direction) of the front face of the printer main body 110. The liquid storage unit 160 has the openable/closable lid 162 thereon.

The liquid storage unit 160 stores a plurality of liquid tanks 300 (300S and 300L). The printer main body 110 is further provided with a carriage 200 equipped with a printing head as the liquid ejection unit.

Figure 17:
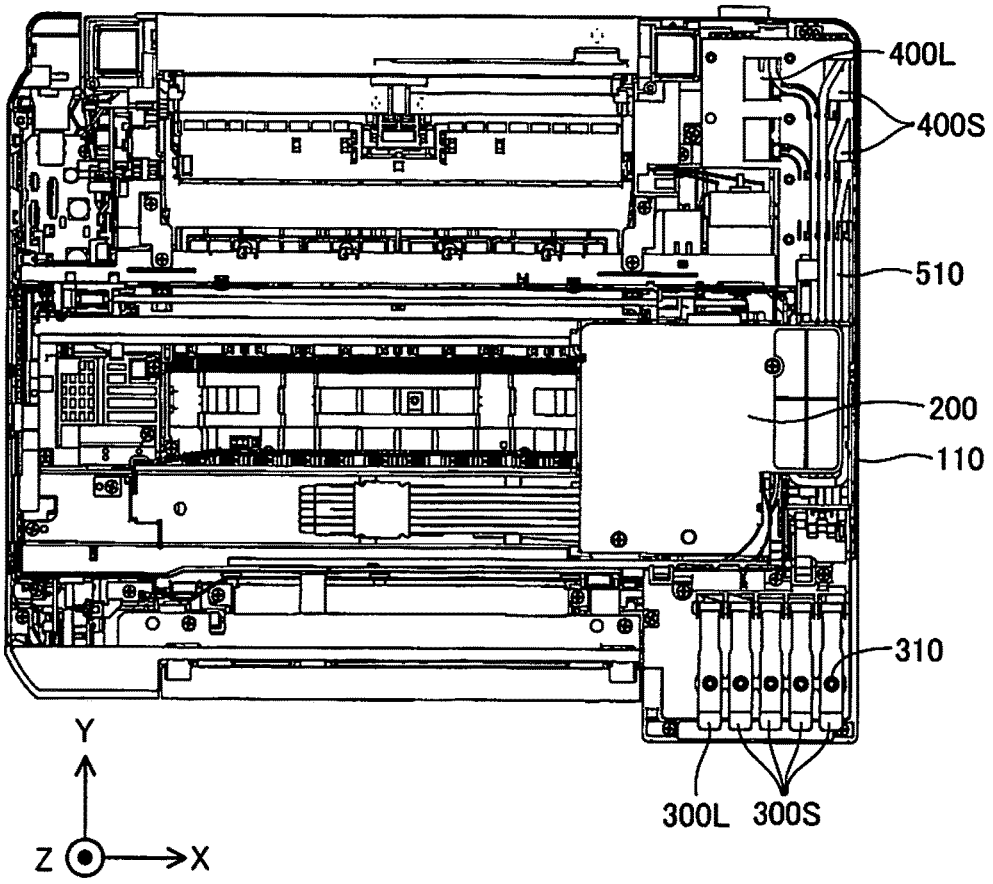
FIG. 17 is a plan view showing an internal structure of the printer of the second embodiment.

FIG. 17 is a plan view showing the internal structure of the printer 1008. Here, some members such as the scanner unit 120 are omitted. A liquid injection portion 310 for injecting liquid into the liquid tank 300 is provided in the upper face of each of the liquid tanks 300.

A plurality of buffer tanks 400 (400S and 400L) are provided rearward of the printer main body 110. In this example, the buffer tanks 400 are installed at a position rearward of the liquid tanks 300. These buffer tanks 400 are respectively connected to the liquid tanks 300 via connection channel members 510. The plurality of liquid tanks 300, the plurality of buffer tanks 400, and the connection channel members 510 constitute a liquid supply apparatus for supplying liquid to the liquid ejection unit (the printing head) of the printer 1008.

Also in the second embodiment, the buffer tanks 400 are connected to the liquid tanks 300, and thus a structure can be achieved in which liquid is unlikely to leak to the outside. Furthermore, the liquid tanks 300 and the buffer tanks 400 are configured separately, and thus there is the advantage of it being easy to increase/decrease the volume of the liquid tanks 300 and the volume of the buffer tanks 400 independently.

In the second embodiment, the plurality of liquid tanks 300 are arranged in the X direction (a first direction). On the other hand, the plurality of buffer tanks 400 are arranged in a direction intersecting the X direction (the Y direction). If such an arrangement is adopted, it is possible to suppress an excessive increase in the size of the liquid supply apparatus 500 in the X direction (the first direction). Note that in this specification, an angle formed when two directions "intersect" is not limited to 90 degrees, and it is meant that an angle formed by those directions is not 0 degrees. Therefore, the Y direction is one direction intersecting the X direction.

Figure 18:
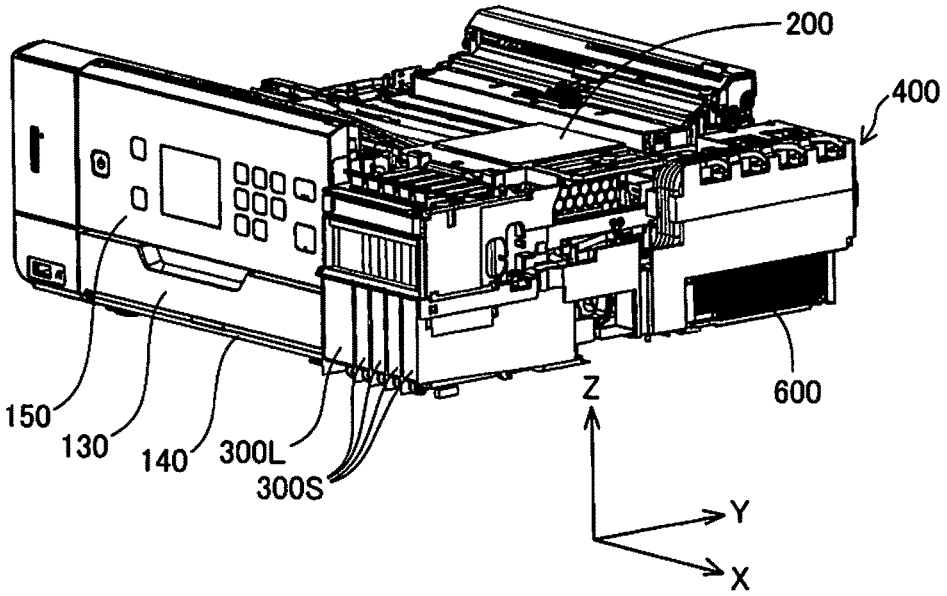
FIG. 18 is a perspective view showing the internal structure of the printer of the second embodiment.

FIG. 18 is a perspective view showing the internal structure of the printer 1008. A waste liquid tank 600 functions as a waste liquid storage portion is provided below the buffer tanks 400. The waste liquid tank 600 is a waste liquid storage portion for containing waste liquid (waste ink) that has been supplied to a liquid ejection unit 210, but was not used for printing. Waste liquid is supplied to the waste liquid tank 600 by a waste liquid pump (not illustrated), for example. The positional relationship between the buffer tanks 400 and the waste liquid tank 600 will be described later. Note that a waste liquid storage portion of a different type such as a waste liquid tray may be used in place of the waste liquid tank 600.

Figure 19:
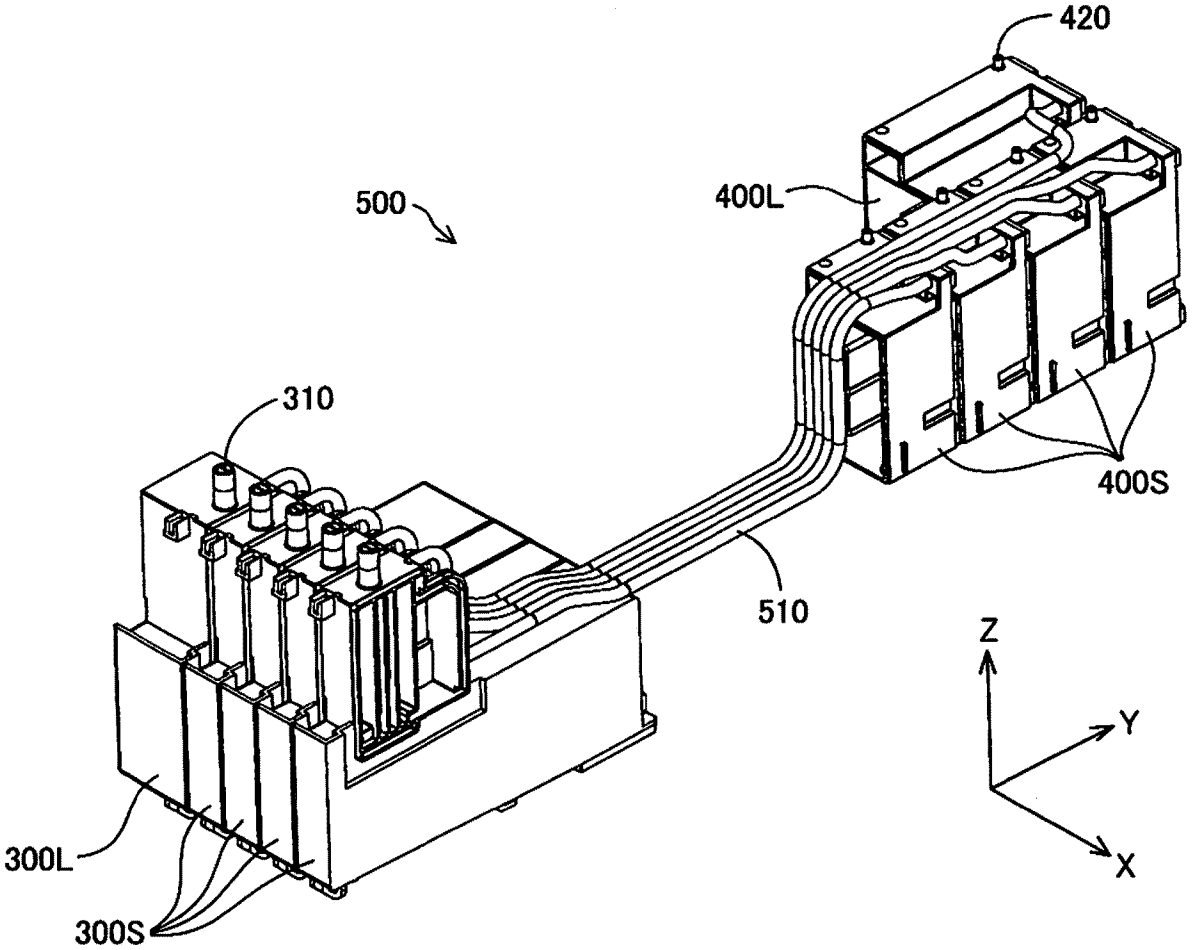
FIG. 19 is a perspective view of a liquid supply apparatus of the second embodiment.
Figure 20:
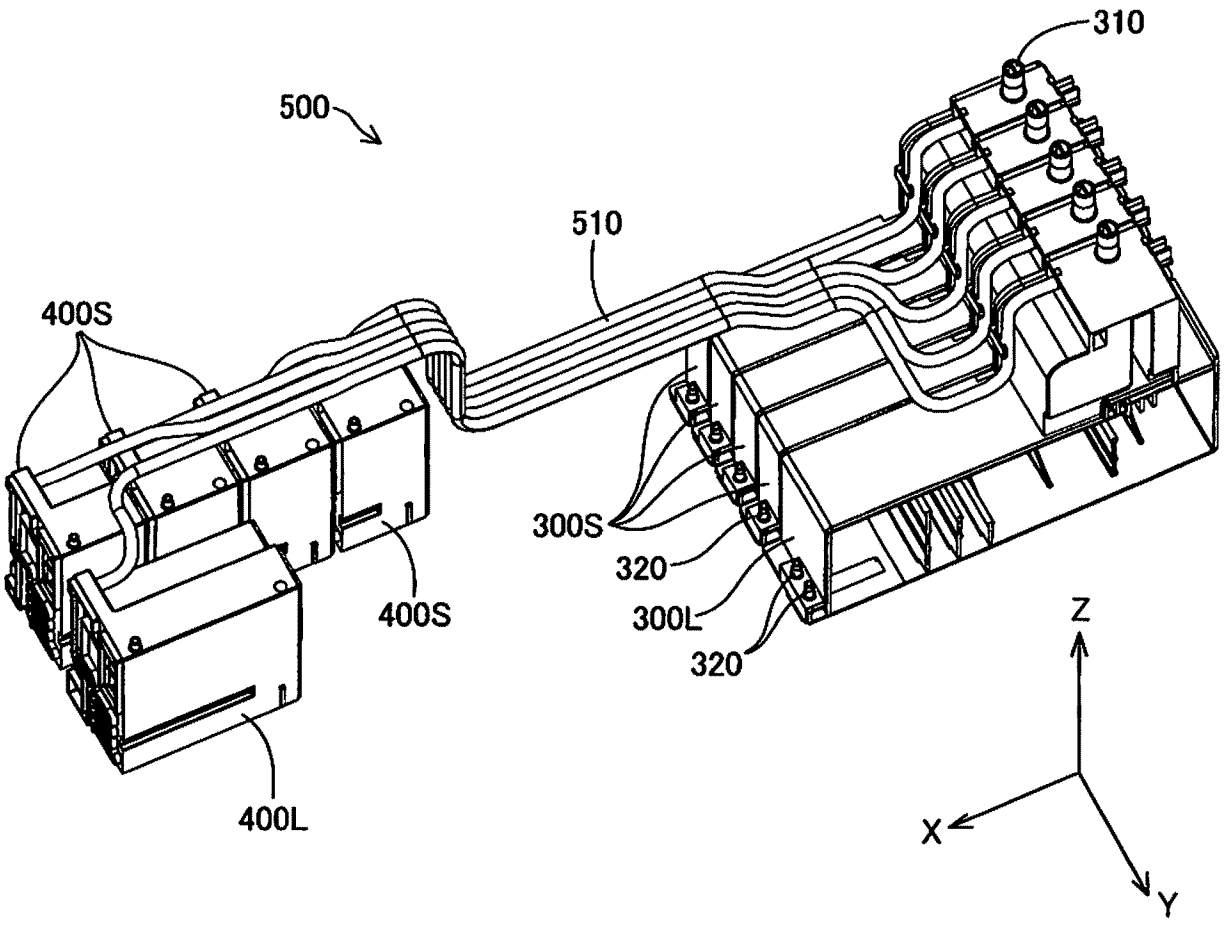
FIG. 20 is a perspective view of the liquid supply apparatus of the second embodiment.

FIGS. 19 and 20 are perspective views of the liquid supply apparatus 500. As described above, the liquid supply apparatus 500 includes the liquid tanks 300, the buffer tanks 400, and the connection channel members 510. The overall configuration of the liquid supply apparatus 500 is substantially the same as the first embodiment shown in FIGS. 4 and 5 except that the buffer tanks 400 are arranged substantially along the Y direction. Note that, to be accurate, a plurality of buffer tanks 400S with a smaller capacity are all arranged in the Y direction, but the buffer tank 400L with a larger capacity is arranged in a direction intersecting the Y direction (the −X direction) relative to the buffer tanks 400S that have a smaller capacity. This configuration is adopted in order to prevent the size in the Y direction of the installation region of all of the buffer tanks 400 from becoming excessively large. As seen from FIG. 17 that has been described above, if the installation region of all of the buffer tanks 400 is excessively long in the Y direction, there is a possibility that the carriage 200 and the buffer tanks 400 will interfere with each other. Also in the overall arrangement in which some of the buffer tanks 400 are arranged along the X direction in this manner, it can be said that the plurality of buffer tanks 400 (in particular, 400S) are arranged in a direction (the Y direction) intersecting a direction (the X direction) in which the liquid tanks 300 are arranged. Note that the plurality of buffer tanks 400 do not need to be arranged in the Y direction, and may be arranged in a direction inclined relative to both the Y direction and the X direction (this also corresponds to a direction intersecting the X direction).

The structure of the liquid tank 300 in the second embodiment is somewhat different from the structure of the liquid tank 300 of the first embodiment described with reference to FIG. 6 to FIG. 9, but the main structure and functions are the same, and a description thereof is omitted.

The same arrangement relationship as described above with reference to FIG. 10 can be adopted as the arrangement relationship in height between the liquid tank 300 and the buffer tank 400 in the second embodiment. Accordingly, if the bottom face of a buffer chamber 430 is installed at a position higher than a maximum liquid level L1 of the liquid tank 300 similarly to the first embodiment, there is the advantage of liquid being unlikely to flow out from a liquid storage chamber 360 to the buffer chamber 430. In addition, liquid that has flowed out from the liquid storage chamber 360 to the buffer chamber 430 is likely to return to the liquid storage chamber 360, and thus the amount of unused liquid can be reduced.

Note that also in the second embodiment, the configurations described with reference to FIGS. 11 to 13 may be adopted as the configuration of the liquid supply apparatus 500 in place of the configuration in FIG. 10.

Figure 21:
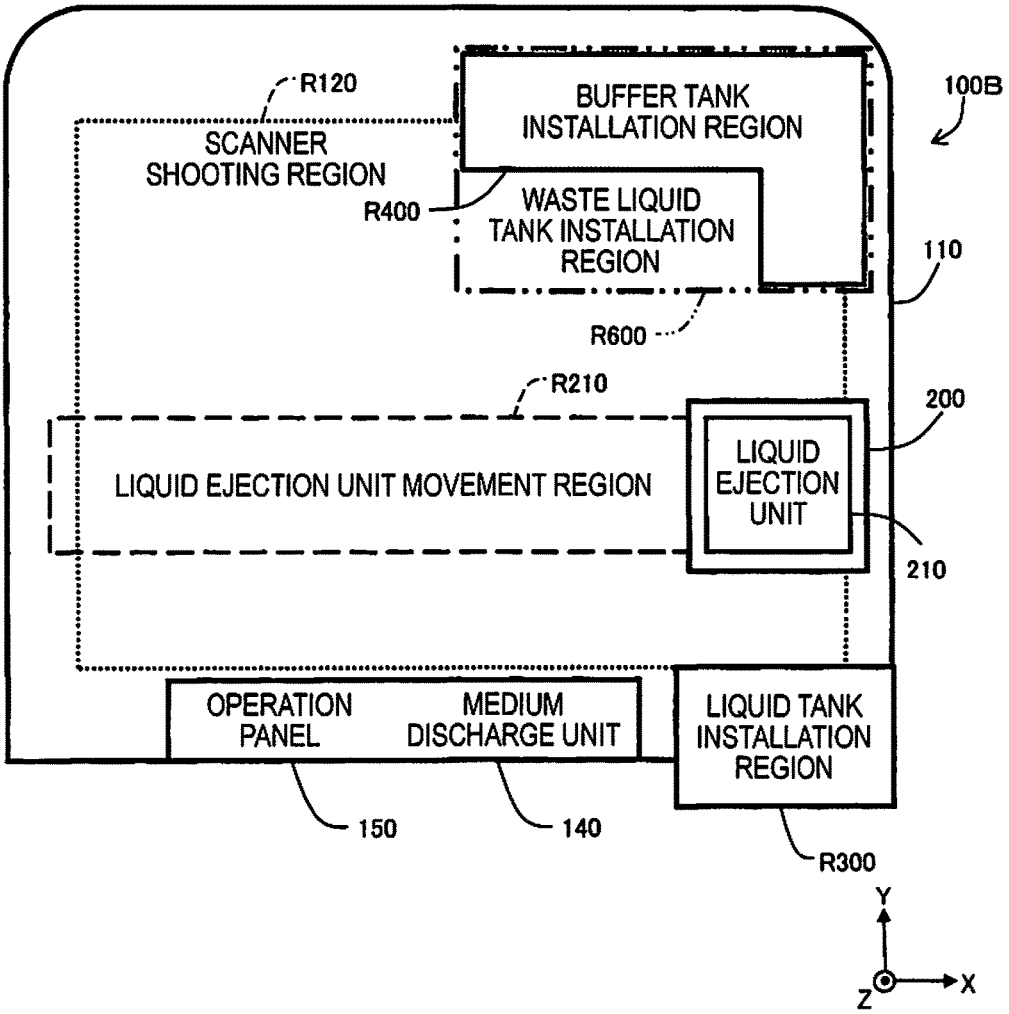
FIG. 21 is an explanatory view showing a plane arrangement of constituent elements of the printer of the second embodiment.

FIG. 21 is an explanatory view showing the plane arrangement of constituent elements of the printer 1008 of the second embodiment. As described above, the medium discharge unit 140 and the operation panel 150 are provided in the front face of the printer main body 110. In FIG. 21, for convenience of illustration, the medium discharge unit 140 and the operation panel 150 are illustrated at the same position. A liquid tank installation region R300 is provided lateral to the medium discharge unit 140 and the operation panel 150. In addition, in the rear portion of the printer main body 110, a buffer tank installation region R400 is provided rearward of the liquid tank installation region R300. In the second embodiment, the buffer tank installation region R400 is positioned rearward (in the +Y direction relative to) of a liquid ejection unit movement region R210. Below the buffer tank installation region R400, the waste liquid tank 600 is installed in a region overlapping the buffer tank installation region R400. The installation region of the waste liquid tank 600 (indicated by a dashed double-dotted line) is referred to as a "waste liquid tank installation region R600".

Also in the second embodiment, similarly to the first embodiment, when the structure of the printer 1008 excluding the liquid supply apparatus 500 is projected from above, at least a portion of the liquid supply apparatus 500 is preferably included inside the outer periphery of the printer 1008. With such a configuration, there is the advantage of being able to suppress an excessive increase in the installation area of the printer 100B.

In addition, in the second embodiment, the liquid tanks 300 are arranged on the same side as the medium discharge unit 140 relative to the liquid ejection unit movement region R210, and the buffer tanks 400 are arranged on the opposite side to the medium discharge unit 140 relative to the liquid ejection unit movement region R210. According to this configuration, it is possible to suppress an increase in the size of the printer 100B in the X direction (the first direction), which is a direction of movement the liquid ejection unit 210. In addition, an empty space is often formed in the periphery of the liquid ejection unit movement region R210, and thus if the above-described arrangement is adopted, the liquid tanks 300 and the buffer tanks 400 can be arranged using this empty space. Furthermore, in this printer 100B, the liquid tanks 300 are arranged on the same side as the medium discharge unit 140 relative to the liquid ejection unit movement region R210, and thus the distance between the liquid tanks 300 and the liquid ejection unit 210 is short, and there is the advantage of liquid being easy to supply to the liquid ejection unit 210.

Note that only some of the liquid tanks 300 may be arranged on the same side as the medium discharge unit 140 relative to the liquid ejection unit movement region R210 instead of arranging all of the liquid tanks 300 on the same side as the medium discharge unit 140 relative to the liquid ejection unit movement region R210. In addition, only some of the buffer tanks 400 may be arranged on the opposite side to the medium discharge unit 140 relative to the liquid ejection unit movement region R210 instead of arranging all of the buffer tanks 400 on the opposite side to the medium discharge unit 140 relative to the liquid ejection unit movement region R210.

In FIG. 21, furthermore, similarly to FIG. 14 of the first embodiment, some of the buffer tanks 400 are arranged at a position overlapping the scanner shooting region R120. If such an arrangement is adopted, it is possible to suppress an increase in the installation area of the printer 1008. Note that all the buffer tanks 400 may be arranged at a position overlapping the scanner shooting region R120.

Figure 22:
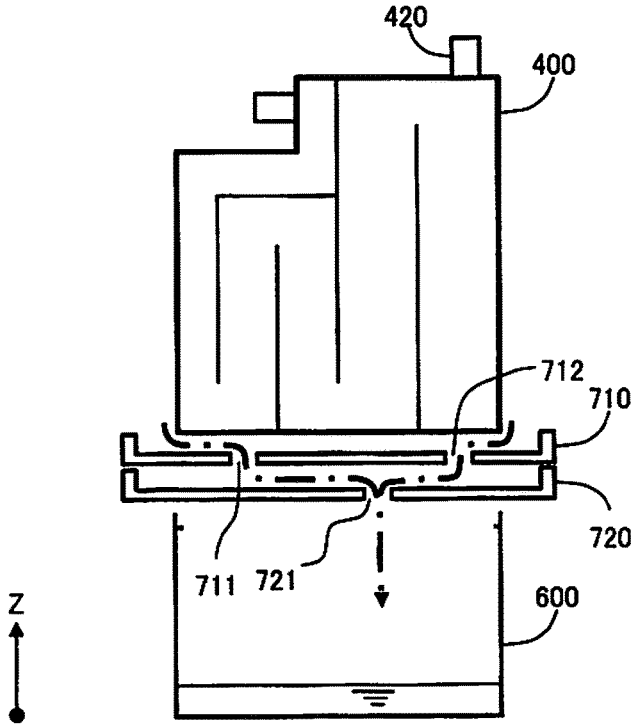
FIG. 22 is an explanatory view showing an example of an arrangement relationship between a buffer tank and a waste liquid tank.

FIG. 22 is an explanatory view showing an example of a positional relationship between the buffer tank 400 and the waste liquid tank 600. Here, the X direction and the Y direction are omitted, and only the Z direction (the up-down direction) is illustrated using an arrow. A waste liquid-absorbent material made of a porous material such as a sponge or a nonwoven fabric, a liquid absorptive high-molecular polymer, or the like may be arranged inside of the waste liquid tank 600. In the example in FIG. 22, the upper portion of the waste liquid tank 600 is not closed by a wall member, and is wide open.

Section walls 710 and 720 that section the buffer tank 400 and the waste liquid tank 600 in the height direction are provided between the buffer tank 400 and the waste liquid tank 600. The plane size of the section walls 710 and 720 is preferably set to a size so as to cover the entire lower side of the installation region of the buffer tanks 400. In addition, the waste liquid tank 600 is preferably installed at a position below at least a portion of the buffer tank 400.

Two openings 711 and 712 are provided in the upper section wall 710. In addition, one opening 721 is provided in the lower section wall 720. These section walls 710 and 720 were envisioned for an undesirable case in which liquid leaks out from an atmospheric air opening port 420 of the buffer tank 400, and are for guiding leaked liquid to the waste liquid tank 600. As indicated by a dashed-dotted line in FIG. 22, liquid that has leaked out from the buffer tank 400 is contained in the waste liquid tank 600 via the openings 711, 712, and 721. Note that the section walls 710 and 720 may be omitted, but it is preferable to provide one or more section walls. If the one or more of the section walls 710 and 720 are provided, in the section wall 720 that is closest to the waste liquid tank 600, the opening 721 is preferably provided in a portion of the section wall 720 facing the waste liquid tank 600.

As in FIG. 22, if the waste liquid tank 600 is arranged below the buffer tank 400, even when liquid leaks out from the buffer tank 400, the liquid is likely to be contained in the waste liquid tank 600, and thus there is the advantage of liquid being unlikely to flow to the outside of the printer 100B. In particular, as the structure in FIG. 22, if the section walls 710 and 720 that section the buffer tank 400 and the waste liquid tank 600 in the height direction are provided, and the opening 721 is provided in a portion of the section wall 720 facing the waste liquid tank 600, even when liquid leaks out from the buffer tank 400, the liquid is likely to be contained in the waste liquid tank 600 via the opening 721 of the section wall 720. In addition, there is the advantage of liquid being unlikely to flow to the outside due to the section walls 710 and 720 excluding the openings 711, 712, and 721, between the buffer tank 400 and the waste liquid tank 600.

Figure 23:
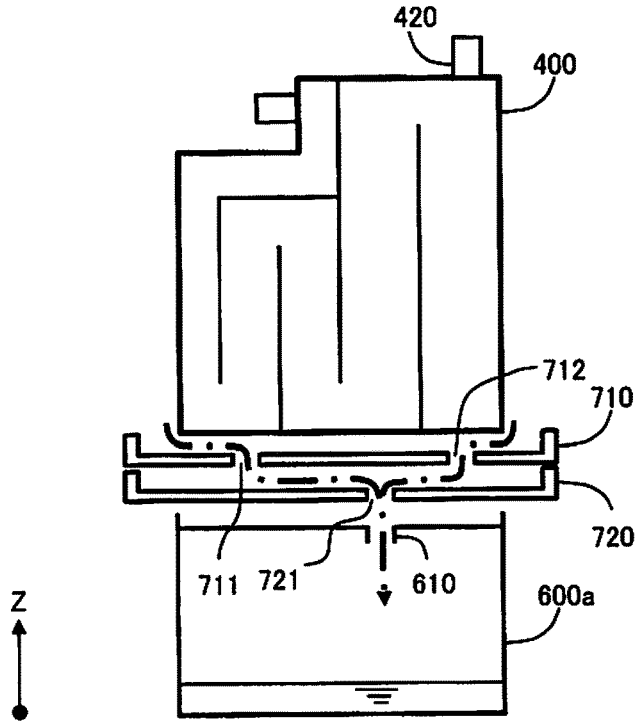
FIG. 23 is an explanatory view showing another example of an arrangement relationship between a buffer tank and a waste liquid tank.

FIG. 23 is an explanatory view showing another example of an arrangement relationship between a buffer tank 400 and a waste liquid tank 600. FIG. 23 is different from FIG. 22 only in that the upper portion of a waste liquid tank 600*a* is closed by a wall member, and a relatively small opening 610 is formed in the wall member, and is otherwise the same as the example in FIG. 22. The opening 610 in the upper wall of the waste liquid tank 600*a* is provided at a position opposing the opening 721 of the section wall 720 that is closest to the waste liquid tank 600. Also in this configuration, an effect similar to that shown in FIG. 22 can be achieved.

Figure 24:
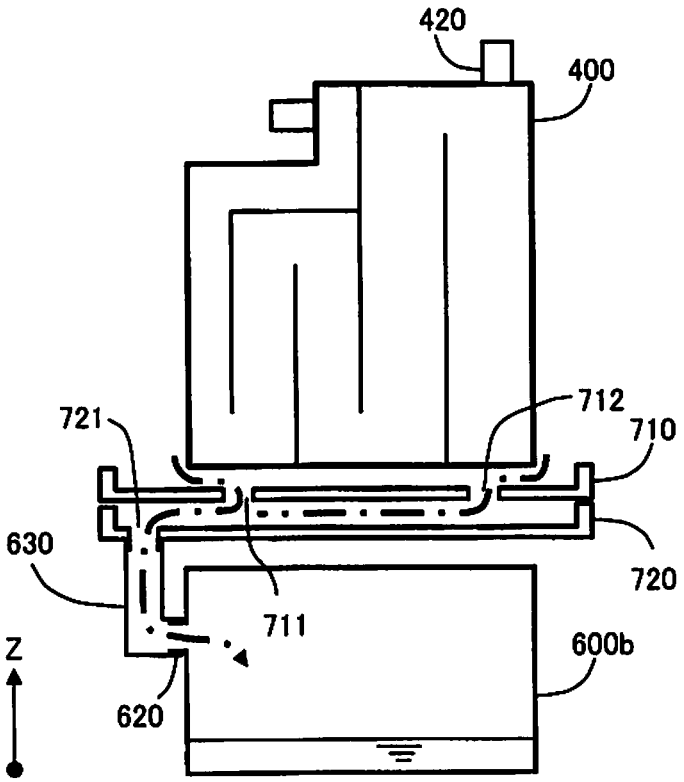
FIG. 24 is an explanatory view showing another example of an arrangement relationship between a buffer tank and a waste liquid tank.

FIG. 24 is an explanatory view showing a yet another example of an arrangement relationship between a buffer tank 400 and a waste liquid tank 600. FIG. 24 is different from FIG. 23 only in that an opening is not provided in the upper portion of a waste liquid tank 600*b*, a connection port 620 is provided in a side face of the waste liquid tank 600*b*, and the connection port 620 is connected to the opening 721 of the section wall 720 using a liquid guiding member 630, and is otherwise the same as the example in FIG. 23. A channel member in various structures such as a tube and a channel that is made by forming a groove in a base member and sealing the groove with a film can be used as the liquid guiding member 630. Also in this configuration, effects similar to those shown in FIGS. 22 and 23 can be achieved.

Note that in FIGS. 22 to 24, examples have been described in which the waste liquid tank 600 is provided below the buffer tank 400, but the waste liquid tank 600 may be provided below the liquid tank 300 in addition to the buffer tank 400 or in place of the buffer tank 400. Accordingly, the waste liquid tank 600 may be arranged so as to be positioned below at least a portion of the liquid tank 300 and the buffer tank 400. With such a configuration, even if liquid leaks out from the liquid tank 300 and/or the buffer tank 400, the liquid is likely to be contained in the waste liquid tank 600, and thus there is the advantage of liquid being unlikely to flow to the outside of the printer. The above-described various arrangements and structures of the waste liquid tank 600 and the section walls 710 and 720 can be applied to the first embodiment similarly.

As described above, also in the second embodiment, similarly to the first embodiment, the buffer tank 400 is connected to the liquid tank 300, and thus there are effects similar to those of the first embodiment such as an effect in that liquid is unlikely to leak to the outside.

In addition, in the second embodiment, the plurality of liquid tanks 300 are arranged in the X direction (the first direction), and the plurality of buffer tanks 400 are arranged in the Y direction (a second direction) intersecting the X direction (the first direction). If such arrangement is adopted, it is possible to suppress an excessive increase in the size of the printer 100B in the X direction (the first direction).

C. Modified Examples

The invention is not limited to the above-described embodiments and their modified examples, and can also be implemented in various aspects without departing from the spirits of the invention, and for example, the following variations are also possible.

The invention is not limited to an inkjet printer and a liquid supply apparatus for the inkjet printer, and can also be applied to any liquid ejection apparatuses that consume liquid other than ink and liquid supply apparatuses used for such liquid ejection apparatuses. For example, the invention can be applied as liquid supply apparatuses used for the following various liquid ejection apparatuses.

(1) An image recording apparatus such as a facsimile apparatus, (2) a color material ejection apparatus used for manufacturing a color filter for an image display device such as a liquid crystal display, (3) an electrode material ejection apparatus used for forming an electrode of an organic EL (Electro Luminescence) display, a surface light emission display (Field Emission Display, FED) or the like, (4) a liquid ejection apparatus for ejecting a liquid containing a biological organic substance used for manufacturing a biochip, (5) a sample ejection apparatus as a precision pipette, (6) a lubricant oil ejection apparatus, (7) a resin liquid ejection apparatus, (8) a liquid ejection apparatus for ejecting lubricant oil onto a precision device such as a timepiece and a camera in a pin-point manner, (9) a liquid ejection apparatus for ejecting transparent resin liquid such as ultraviolet-curing resin liquid onto a substrate in order to form a microhemispherical lens (an optical lens) or the like used in an optical communication element or the like,

(10) a liquid ejection apparatus for ejecting acidic or alkaline etching liquid in order to etch a substrate or the like, and

(11) a liquid ejection apparatus provided with a liquid consumption head for discharging a very small amount of droplets of any other liquid Note that a "droplet" refers to a state of liquid discharged from a liquid ejection apparatus, and includes a granular shape, a tear-drop shape, and a shape having a thread-like trailing end. In addition, the "liquid" mentioned here may be any kind of material that can be consumed by the liquid ejection apparatus. For example, the "liquid" need only to be a material whose substance is in the liquid phase, and includes fluids such as an inorganic solvent, an organic solvent, a solution, a liquid resin, and a liquid metal (metal melt) in the form of a material in the state of liquid having a high or low viscosity, a sol, gel water, or the like. In addition, the "liquid" is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink.

What is claimed is:

1. A printing apparatus comprising:

a movable liquid ejection unit;

a liquid supply apparatus for supplying a liquid to a liquid ejection unit; and a medium discharging unit, wherein the liquid supply apparatus includes a liquid tank that contains the liquid, a connection channel member connected to the liquid tank, and a buffer tank configured separately from the liquid tank, the buffer tank being connected to the liquid tank via the connection channel member, and being communicated with atmospheric air, the liquid tank has a liquid storage chamber provided inside the liquid tank and a liquid inlet portion for injecting the liquid into the liquid storage chamber, the liquid inlet portion being closed using a cap when the liquid ejection unit executes liquid jet printing, the buffer tank has a buffer chamber, with a bottom face of the buffer chamber being positioned at a position higher than a maximum liquid level of the liquid tank, the liquid tank includes a plurality of the liquid storage chambers that are arranged in a first direction, the plurality of the liquid storage chambers containing a plurality of different types of liquid, the buffer tank includes a plurality of the buffer chambers arranged in a second direction intersecting the first direction, the medium discharging unit discharges, in the second direction, a printing medium printed onto by ejecting the liquid from the liquid ejection unit, at least a portion of the liquid tank is positioned on the same side as the medium discharging unit relative to a movement region of the liquid ejection unit that moves in the first direction, and at least a portion of the buffer tank is positioned on an opposite side to the medium discharging unit relative to the movement region.

2. The printing apparatus according to claim 1, wherein the connection channel member is held higher than the maximum liquid level.

3. The printing apparatus according to claim 1, wherein, when the printing apparatus excluding the liquid supply apparatus is projected from above, at least a portion of the liquid supply apparatus is included inside an outer periphery of the printing apparatus.

4. The printing apparatus according to claim 1, wherein the buffer tank includes a plurality of the buffer chambers arranged in a direction parallel to the first direction.

5. The printing apparatus according to claim 4, further comprising an operation panel positioned above the medium discharging unit, wherein at least a portion of the buffer tank is arranged between the operation panel and the movement region.

6. The printing apparatus according to claim 5, further comprising a scanner unit, wherein at least a portion of the buffer tank is arranged at a position overlapping a shooting region of the scanner unit.

7. The printing apparatus according to claim 5, further comprising a waste liquid storage portion that can contain a liquid, wherein the waste liquid storage portion is positioned below at least a portion of the liquid tank and the buffer tank.

8. The printing apparatus according to claim 7, further comprising a section wall that sections between the waste liquid storage portion and at least a portion of the liquid tank and the buffer tank in a height direction, and an opening is provided in a portion of the section wall facing the waste liquid storage portion.

9. The printing apparatus according to claim 7, further comprising a section wall that sections between the waste liquid storage portion and at least a portion of the liquid tank and the buffer tank in a height direction, wherein the section wall has an opening, and the opening and the waste liquid storage portion are connected through a liquid guiding member.

10. A liquid supply apparatus for supplying a liquid to a liquid ejection unit, comprising:

a liquid tank that contains a liquid;

a connection channel member connected to the liquid tank; and a buffer tank configured separately from the liquid tank, the buffer tank being connected to the liquid tank via the connection channel member, and being communicated with atmospheric air, wherein the liquid tank includes a liquid storage chamber provided inside the liquid tank and a liquid inlet portion for injecting the liquid into the liquid storage chamber, the liquid tank provides a first liquid level at a height lower than or equal to an end portion of the liquid inlet portion that is open to the inside of the liquid storage chamber, the first liquid level is set as an indicator of an upper limit of an amount of the liquid that is contained in the liquid tank, the buffer tank has a buffer chamber, with a bottom face of the buffer chamber being positioned at a position lower than the first liquid level, the connection channel member connects the liquid tank and the buffer tank via a position higher than the first liquid level, the buffer tank includes the buffer chamber, an air chamber including an atmospheric air opening port, and a partition wall that partitions the buffer chamber and the air chamber, and the buffer chamber and the air chamber are in communication with each other through an opening provided in an upper portion of the partition wall.

11. A printing apparatus comprising:

a liquid ejection unit; and the liquid supply apparatus according to claim 10.

* * * * *